US012281531B2

(12) United States Patent
Rewerts et al.

(10) Patent No.: US 12,281,531 B2
(45) Date of Patent: Apr. 22, 2025

(54) HORIZONTAL DIRECTIONAL DRILL WITH FREEWHEEL MODE

(71) Applicant: Vermeer Manufacturing Company, Pella, IA (US)

(72) Inventors: Jacob Rewerts, Altoona, IA (US); Zach Buckley, Ankeny, IA (US); Robert D. Franz, Independence, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 18/431,674

(22) Filed: Feb. 2, 2024

(65) Prior Publication Data

US 2024/0175321 A1 May 30, 2024

Related U.S. Application Data

(62) Division of application No. 17/945,967, filed on Sep. 15, 2022, now Pat. No. 12,110,753.

(Continued)

(51) Int. Cl.
*E21B 3/02* (2006.01)
*E21B 7/04* (2006.01)

(Continued)

(52) U.S. Cl.
CPC ..... *E21B 3/02* (2013.01); *E21B 7/046* (2013.01); *E21B 19/083* (2013.01); *E21B 19/165* (2013.01); *E21B 44/02* (2013.01)

(58) Field of Classification Search
CPC ..... E21B 3/02; E21B 7/046; E21B 19/083; E21B 19/165; E21B 44/02
See application file for complete search history.

(56) References Cited

U.S. PATENT DOCUMENTS 3,811,525 A 5/1974 Stuart
3,815,478 A 6/1974 Axelsson et al.

(Continued)

FOREIGN PATENT DOCUMENTS

DE 102011108206 A1 1/2013
DE 102013016955 A1 10/2014

(Continued)

OTHER PUBLICATIONS

Eom et al., "Human-Automation Interaction Design for Adaptive Cruise Control Systems of Ground Vehicles", Sensors, 2015, vol. 15, pp. 13916-13944.

(Continued)

*Primary Examiner* — Taras P Bemko
(74) *Attorney, Agent, or Firm* — Michael Best & Friedrich LLP

(57) ABSTRACT

A horizontal directional drilling machine includes a drill string rotational drive unit having an output member configured to connect with and selectively drive rotation of a drill string, the rotational drive unit including a hydraulic motor. A hydraulic circuit has a configuration that puts the motor in a drive mode to apply torque and a second configuration that puts the motor in a freewheel mode disabled from applying torque. The hydraulic circuit includes a first fluid flow path for connecting the hydraulic motor through a first rotary ball valve to one of an inlet side and an outlet side of a drive pump, and a second fluid flow path for selectively connecting the hydraulic motor through a second rotary ball valve to the other side of the drive pump. In the first configuration, there is no pressure drop across the first and second rotary ball valves.

3 Claims, 13 Drawing Sheets

Related U.S. Application Data

(60) Provisional application No. 63/331,318, filed on Apr. 15, 2022, provisional application No. 63/324,408, filed on Mar. 28, 2022.

(51) Int. Cl.
*E21B 19/083* (2006.01)
*E21B 19/16* (2006.01)
*E21B 44/02* (2006.01)

(56) References Cited

U.S. PATENT DOCUMENTS

| | | | | |
|---|---|---|---|---|
| 4,117,895 | A | 10/1978 | Ward et al. | |
| 4,328,621 | A * | 5/1982 | Benjamin | G01B 7/30 33/534 |
| 4,945,816 | A | 8/1990 | Mestieri | |
| 5,117,936 | A | 6/1992 | Nakamura et al. | |
| 6,101,986 | A | 8/2000 | Brown et al. | |
| 6,367,572 | B1 | 4/2002 | Maletschek et al. | |
| 6,408,952 | B1 | 6/2002 | Brand et al. | |
| 6,508,328 | B1 | 1/2003 | Kenyon et al. | |
| 6,585,062 | B2 | 7/2003 | Rozendaal et al. | |
| 6,766,869 | B2 | 7/2004 | Brand et al. | |
| 9,560,692 | B2 | 1/2017 | McGee et al. | |
| 9,598,905 | B2 | 3/2017 | Van Zee et al. | |
| 10,563,458 | B2 | 2/2020 | Horst et al. | |
| 2002/0006698 | A1 | 1/2002 | Noble | |
| 2002/0195275 | A1 | 12/2002 | Brand et al. | |
| 2010/0133009 | A1 | 6/2010 | Carlson et al. | |
| 2010/0139982 | A1 | 6/2010 | Carlson et al. | |
| 2011/0172858 | A1* | 7/2011 | Gustin | B63H 21/213 701/21 |
| 2013/0195704 | A1 | 8/2013 | Prigent et al. | |
| 2013/0305702 | A1 | 11/2013 | Essig | |
| 2014/0100079 | A1 | 4/2014 | Schubert | |
| 2014/0102799 | A1 | 4/2014 | Stringer et al. | |
| 2014/0271244 | A1 | 9/2014 | Gray, Jr. | |
| 2015/0251533 | A1 | 9/2015 | Heren et al. | |
| 2017/0248000 | A1 | 8/2017 | Hundt et al. | |
| 2017/0259798 | A1* | 9/2017 | Toole | B60T 13/14 |
| 2018/0171718 | A1 | 6/2018 | Greenlee et al. | |
| 2018/0179822 | A1 | 6/2018 | Horst et al. | |
| 2020/0024909 | A1* | 1/2020 | Knijpstra | E21B 15/04 |
| 2020/0102791 | A1 | 4/2020 | Sartori et al. | |
| 2020/0165885 | A1 | 5/2020 | Horst et al. | |
| 2021/0053541 | A1 | 2/2021 | Kirby et al. | |
| 2021/0115777 | A1* | 4/2021 | Slaughter, Jr. | E21B 44/00 |

FOREIGN PATENT DOCUMENTS

| | | | |
|---|---|---|---|
| EP | 2508382 | A1 | 10/2012 |
| WO | 2010107606 | A2 | 9/2010 |
| WO | 2010130357 | A2 | 11/2010 |
| WO | 2013019746 | A2 | 2/2013 |
| WO | 2013019754 | A2 | 2/2013 |
| WO | 2014087019 | A1 | 6/2014 |
| WO | 2014087021 | A1 | 6/2014 |

OTHER PUBLICATIONS

International Search Report and Written Opinion for Application No. PCT/US2022/043716 dated Feb. 20, 2023 (27 pages).

International Search Report and Written Opinion for Application No. PCT/US2022/043761 dated Nov. 28, 2022 (14 page).

Parker Hannifin Corporation, "Technical Information", 2011, 32 pages.

Patent Cooperation Treaty Invitation to Pay Additional Fees for Application No. PCT/US2022/043716 dated Dec. 5, 2022 (18 pages).

Poclain Hydraulics, "MI250 High Displacement Motors", Product Information, 2016, 5 pages.

Poclain Hydraulics, "MS Range Hydraulic Motors", Production Information, 2016, 13 pages.

Poclain Hydraulics, "MS83/MS125 Large Size Hydraulic Motors", Product Information, 2016, 5 pages.

Reidville Hydraulics & MFG, "Noresman Motor Functions", Technical Information, 1998, 1 page.

YouTube, "Poclain Hydraulics Motor Technology", <https:www.youtube.com/watch?v=G5qd-HxNuNM>, Jul. 2020, 6 pages including 1 page transcript.

* cited by examiner

HORIZONTAL DIRECTIONAL DRILL WITH FREEWHEEL MODE

CROSS-REFERENCE TO RELATED APPLICATIONS

This application is a divisional of co-pending U.S. patent application Ser. No. 17/945,967, filed Sep. 15, 2022, which claims the benefit of priority to U.S. Provisional Patent Application No. 63/331,318, filed Apr. 15, 2022 and U.S. Provisional Patent Application No. 63/324,408, filed Mar. 28, 2022, the entire contents of all of which are incorporated by reference herein.

BACKGROUND

The present disclosure relates to underground drilling machines such as horizontal directional drilling (HDD) machines. Aspects of the disclosure relate particularly to the ability for an exit side HDD machine to have a selectable freewheel mode within the rotational drive unit thereof, for example when used as an exit side rig in a dual rig operation.

SUMMARY

The present disclosure provides, in one aspect, a horizontal directional drilling machine including a drill string rotational drive unit having an output member configured to connect with and selectively drive rotation of a drill string. The rotational drive unit includes a hydraulic motor. A hydraulic circuit has a configuration that puts the motor in a drive mode to apply torque and a second configuration that puts the motor in a freewheel mode disabled from applying torque. The hydraulic circuit includes a first fluid flow path for connecting the hydraulic motor through a first rotary ball valve to one of an inlet side and an outlet side of a drive pump, and a second fluid flow path for selectively connecting the hydraulic motor through a second rotary ball valve to the other one of the inlet side and the outlet side of the drive pump. When the hydraulic circuit is in the first configuration and fluid flows between the drive pump and the hydraulic motor along the first and second fluid flow paths, there is no pressure drop across the first and second rotary ball valves.

The present disclosure provides, in another aspect, a horizontal directional drilling machine including a cam-lobe radial piston hydraulic motor having an output member configured to connect with and selectively drive rotation of a drill string. A hydraulic circuit has a first configuration that puts the hydraulic motor in a drive mode to apply torque to the drill string through the output member. The hydraulic circuit has a second configuration that puts the hydraulic motor in a freewheel mode disabled from applying torque to the drill string. The hydraulic circuit includes a first fluid flow path for selectively connecting the hydraulic motor to one of an inlet side and an outlet side of a drive pump, and a second fluid flow path for selectively connecting the hydraulic motor to the other of the inlet side and the outlet side of the drive pump. When the hydraulic circuit is in the freewheel mode, the first and second fluid flow paths are blocked. When the hydraulic circuit is in the drive mode, there is no reduction in cross-sectional area along the first fluid flow path and there is no reduction in cross-sectional area along the second fluid flow path.

The present disclosure provides, in yet another aspect, a horizontal directional drilling machine including a cam-lobe radial piston hydraulic motor having an output member configured to connect with and selectively drive rotation of a drill string. The hydraulic motor is operable in a drive mode to enable torque application to the drill string through the output member, and the hydraulic motor is operable in a freewheel mode disabled from applying torque to the drill string. A hydraulic circuit includes rotary ball valves operable to control the flow of fluid to and from the hydraulic motor for switching the hydraulic motor between the drive and freewheel modes.

The present disclosure provides, in yet another aspect, a horizontal directional drilling machine including a rotational drive unit having an output member configured to connect with and selectively drive rotation of a drill string when the rotational drive unit is in a first mode. The output member of the rotational drive unit is configured to be rotated by the drill string when the rotational drive unit is in a second mode. An operator input device allows an operator to select between the first and second modes of the rotational drive unit. A display is configured to display information regarding the status of the rotational drive unit to the operator, including displaying whether the rotational drive unit is in the first mode or the second mode. A control system includes a controller connected for signal communication with the rotational drive unit, the operator input device, and the display. The control system is configured to, in response to receiving an input to the operator input device to change between the first and second modes: transition the rotational drive unit between the first and second modes, and change the response of one or both of the operator input device and the display to provide an indication to the operator that the rotational drive unit is in transition between the first and second modes. Other features and aspects of the disclosure will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
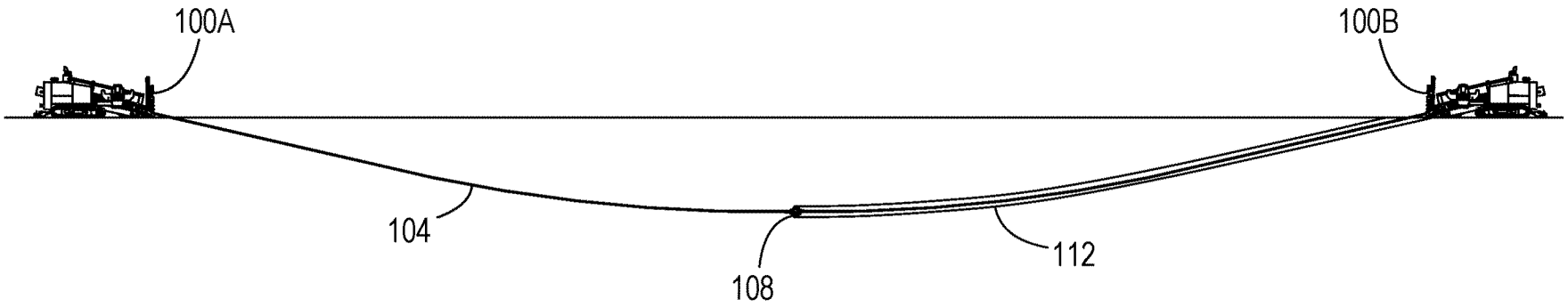
FIG. 1 is a schematic drawing of a dual rig horizontal directional drilling setup.

FIG. 1 is a schematic of a so-called "dual rig" horizontal directional drilling (HDD) setup for an underground drilling (e.g., and subsequent reaming) operation, in which there are provided two HDD machines or rigs 100A, 100B. The first HDD machine 100A is the "pilot side" machine placed at the entry side, and the second HDD machine 100B is the exit side machine. The pilot side HDD machine 100A is used to build up a drill string 104 that is guided underground from an entry opening in the ground along a drill path, establishing a pilot hole, toward an exit opening in the ground where the exit side HDD machine 100B is positioned. Once the pilot hole is complete and the head of the drill string 104 is exposed at the exit opening, a reamer 108 (i.e., "back reamer") can be attached to the drill string 104 for a back reaming operation—pulling the reamer 108 back through the pilot hole from the exit opening to the entry opening at the first HDD machine 100A. Although some reaming operations are completed only by use of a single HDD machine at the entry opening, a second HDD machine (i.e., the exit side HDD machine 100B) can be used during backstreaming in combination with the entry side HDD machine 100A, for example to provide additional drilling fluid from the exit side and to assist in controlling longitudinal forces on the reamer 108 and the drill string 104. To accomplish this, a separate drill string 112 of connected rods extends from the reamer 108 to the exit side HDD machine 100B. This secondary drill string 112 may be referred to as a tail string, a trailed string, or ream string. See for example U.S. Pat. No. 6,585,062 and the disclosure of the anchoring machine 33 shown in FIG. 3 therein. The entire contents of U.S. Pat. No. 6,585,062 are incorporated herein by reference.

Figure 2:
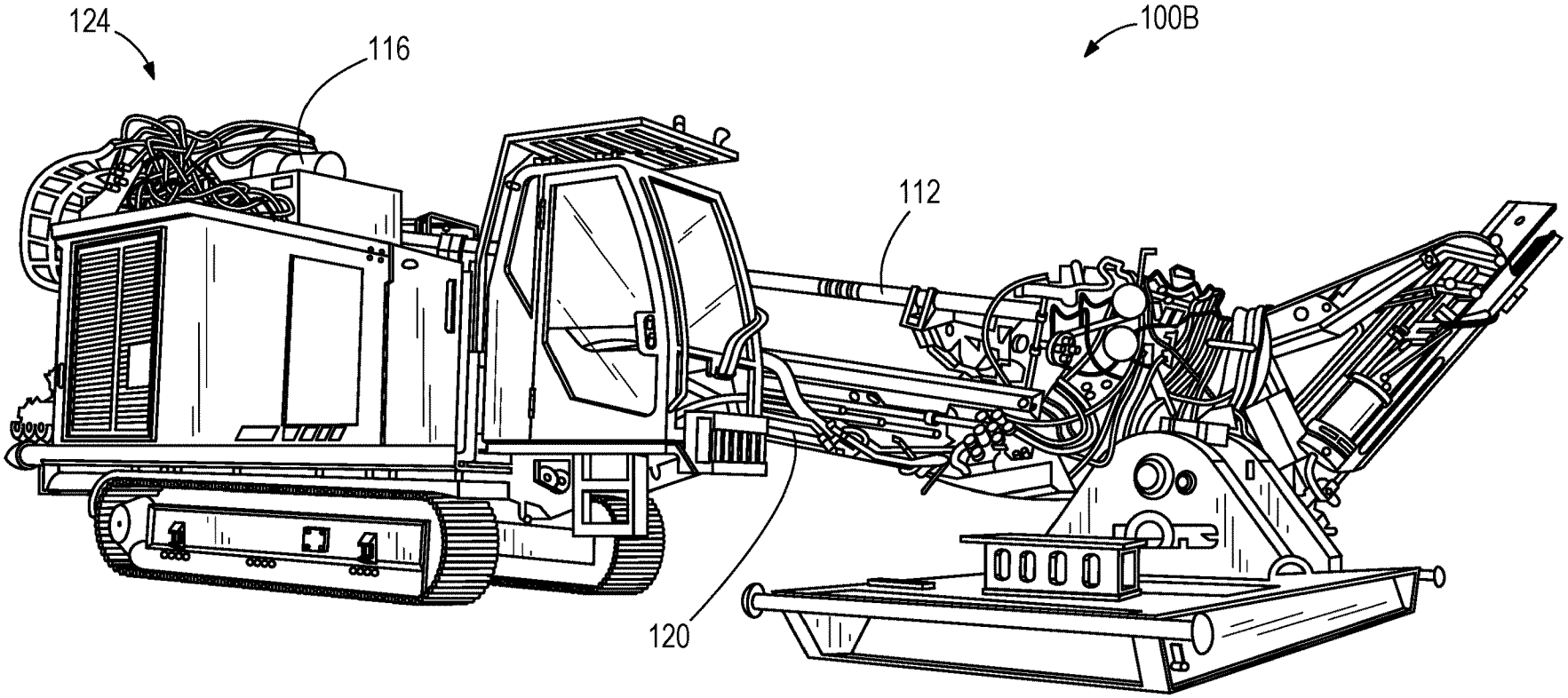
FIG. 2 is a perspective view of an exemplary horizontal directional drill (HDD) rig.

It is not uncommon for the rotation of the tail string 112 to be inconsistent during the reaming operation. As the reamer 108 engages the ground formation, it very often encounters variation of properties within the ground formation, and this can result in variations in the torque required to rotate the reamer 108. This characteristic combined with the torque wind-up of the drill string 104 results in variations of revolutions per minute (rpm) of the reamer 104 and the tail string 112. At times this variation can become significant. Thus, in a set-up where the tail string 112 is coupled directly to the reamer 108, as illustrated in FIG. 1, there is a requirement for the rotational drive unit 116 of the exit side HDD machine 100B to follow the rotation of the reamer 108. The embodiment described in detail herein is a configuration which uses one method of allowing the rotational drive unit 116 of the exit side HDD machine 100B to follow the rotation of the reamer 108, to allow the tail string 112, which extends from the reamer 108 to the exit side HDD machine 100B, to rotate freely in order to follow the rotation of the reamer 108. In other embodiments the rotational drive unit 116 of the exit side HDD machine 100B can be configured in different ways to follow the rotation of the reamer 108. In any configuration, the tail string 112 is coupled to the rotational drive unit (or "rotary drive") 116 of the exit side HDD machine 100B (FIG. 2) at its end so that the fluid system of the exit side HDD machine 100B can pump drilling fluids to the reamer 108. There are also advantages of having the tail string 112 connected to the rotational drive unit 116 that is drivable by a carriage drive system along the rack 120 of the exit side HDD machine 100B, as that allows the carriage 124 of the exit side HDD machine 100B to be utilized to contribute longitudinal force on the reamer 108 and the drill string 104, either:

1) applying a pushing force onto the reamer 108, in a direction away from the exit-side HDD machine 100B and towards the pilot side HDD machine 100A, during which the tail string 112 will be in compression; or
2) applying a pulling force onto the reamer 108, in a direction towards the exit-side HDD machine 100B, during which the tail string 112 will be in tension.

In order to allow the tail string 112 to rotate freely in the embodiment described herein, to follow the rotation of the reamer 108, the rotational drive unit 116 of the exit side HDD machine 100B can be enabled with a freewheel mode. As explained in further detail below, the freewheel mode is a mode that occurs within the rotational drive unit 116, which allows free rotation of the tail string 112 (i.e., without opposing torque/drag) while it remains connected to the rotational drive unit 116—rather than a disconnection of the tail string 112 from the rotational drive unit 116. Through this connection the exit side HDD machine 100B is able to push or pull the reamer 108 in coordination with the entry side HDD machine 100A that is pulling and rotating the reamer 108.

Figure 3:
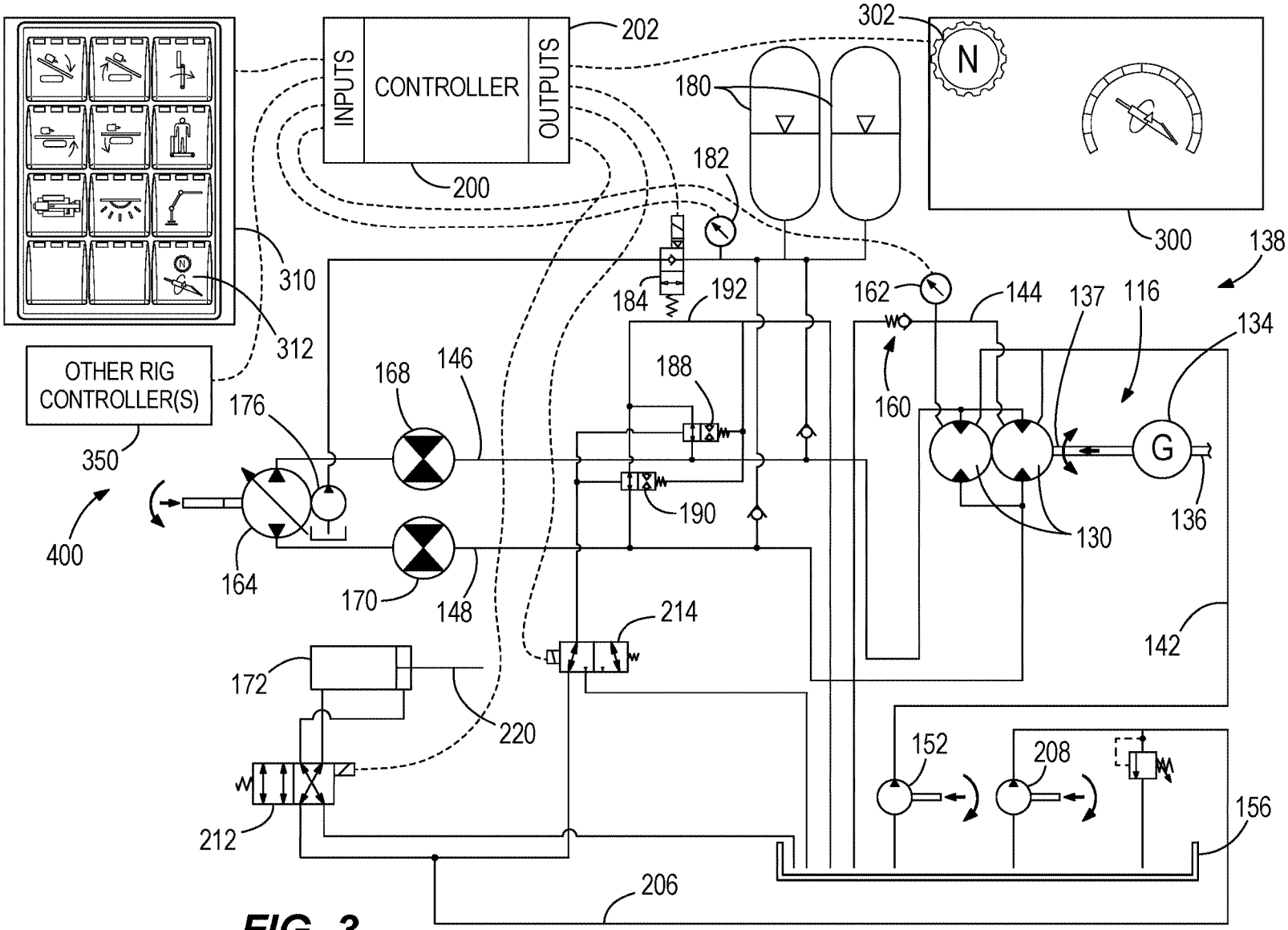
FIG. 3 is a schematic view of a hydraulic system including the rotational drive unit of the HDD rig.

As illustrated in FIG. 3, the rotational drive unit 116 can include one or more hydraulic motors 130 as well as a gearbox 134, ultimately terminating with an output member 136 in the form of a shaft or spindle adapted for connection with the drill string. Although the rotational drive unit output member 136 is adapted to transfer torque generated by the one or more hydraulic motors 130 when in the drive mode to rotate the drill string in a selected direction (selectable as either forward or reverse), it will also be understood that the output member 136 may be rotated by the drill string (freely in either direction) when in the freewheel mode. Rotation from the drill string to the rotational drive unit output member 136 in the freewheel mode also rotates a hydraulic motor output member 137, as it remains connected with the output member 136 through the gearbox 134. Within the rotational drive unit 116, an input (e.g., shaft) of the gearbox 134 is coupled to an output (e.g., shaft) of the hydraulic motor(s) 130. In the schematic of FIG. 3, a tandem motor setup is shown. Although further references below refer to the motors 130, aspects of the disclosure may also apply to a single motor or more than two motors 130. The gearbox 134 can be integrated with the motors 130 in some constructions, while in other constructions the rotational drive unit 116 can be provided without a gearbox such that the output member 137 is the output of the rotational drive unit 116. Also, not shown, a clutch and/or brake may also be provided in the rotational drive unit 116, also optionally constructed as an integrated portion of the motors 130.

In addition to the rotational drive unit 116, FIG. 3 illustrates a rotary drive control system 400 comprising a hydraulic control system 138, a controller 200, an operator input device 310 and an operator display 300. In this embodiment, each hydraulic motor 130 can be a cam-lobe radial piston motor that can be operated in two distinct modes as controlled by the control system 138 and the controller 200. As described in further detail below, one mode is a drive mode (FIG. 5), optionally referred to as normal mode, normal drive mode, or drilling mode, wherein a rotor of the motor 130, including a set of radial pistons, is coupled with high pressure and low pressure hydraulic fluid for causing reciprocation of the set of radial pistons and a corresponding rotation of the rotor within the case of the motor 130. The hydraulic control system 138 is configured to provide a low-level of pressurized oil in the motors 130 by way of pump 176, which is connected to accumulators 180 and a pair of check valves, to maintain the charge pressure which acts on the radial pistons, keeping the outer ends of the radial pistons in contact with a convoluted wave surface along the interior of the case. As each piston is exposed to the high and low pressure sequentially, in register with the wave surface, the piston reciprocation leads to continuous rotation of the rotor as a whole. The rotation is provided directly or indirectly from the rotor to the output 136 of the rotational drive unit 116. In other words, the rotor or a portion thereof can be considered an output member of the motor 130.

The other mode of the motor 130 is a freewheel mode (FIG. 4), optionally referred to as free-spool or neutral, wherein the charge pressure is eliminated and a prevailing case pressure of hydraulic fluid within the motor 130 forces the set of radial pistons inward, to retracted positions, to effectively decouple the rotor from the radial pistons. When the charge pressure is eliminated, the high pressure (output) and low pressure (input) sides of a main pump or drive pump 164 are not connected to any source of fluid, and the case pressure prevails pushing the pistons inward, the motor 130 is in the freewheel mode. In this mode the rotor and the connected output 136, can rotate freely, without affecting the radial pistons. In should be understood that a slight amount of drag may be incurred by the motor 130 when rotated from external means in the freewheel mode. However, the drag may be relatively or completely imperceptible to the external drive source (pilot side HDD machine 100A) as compared to the down-hole drag. As described in further detail below, the control system 400 can change the response or status of one or both of the operator input device 310 and the display 300 to provide an indication to the operator that the rotational drive unit is in either the normal mode or the freewheel mode, and may further change the response or status to provide indication of a transition between these modes.

Figure 4:
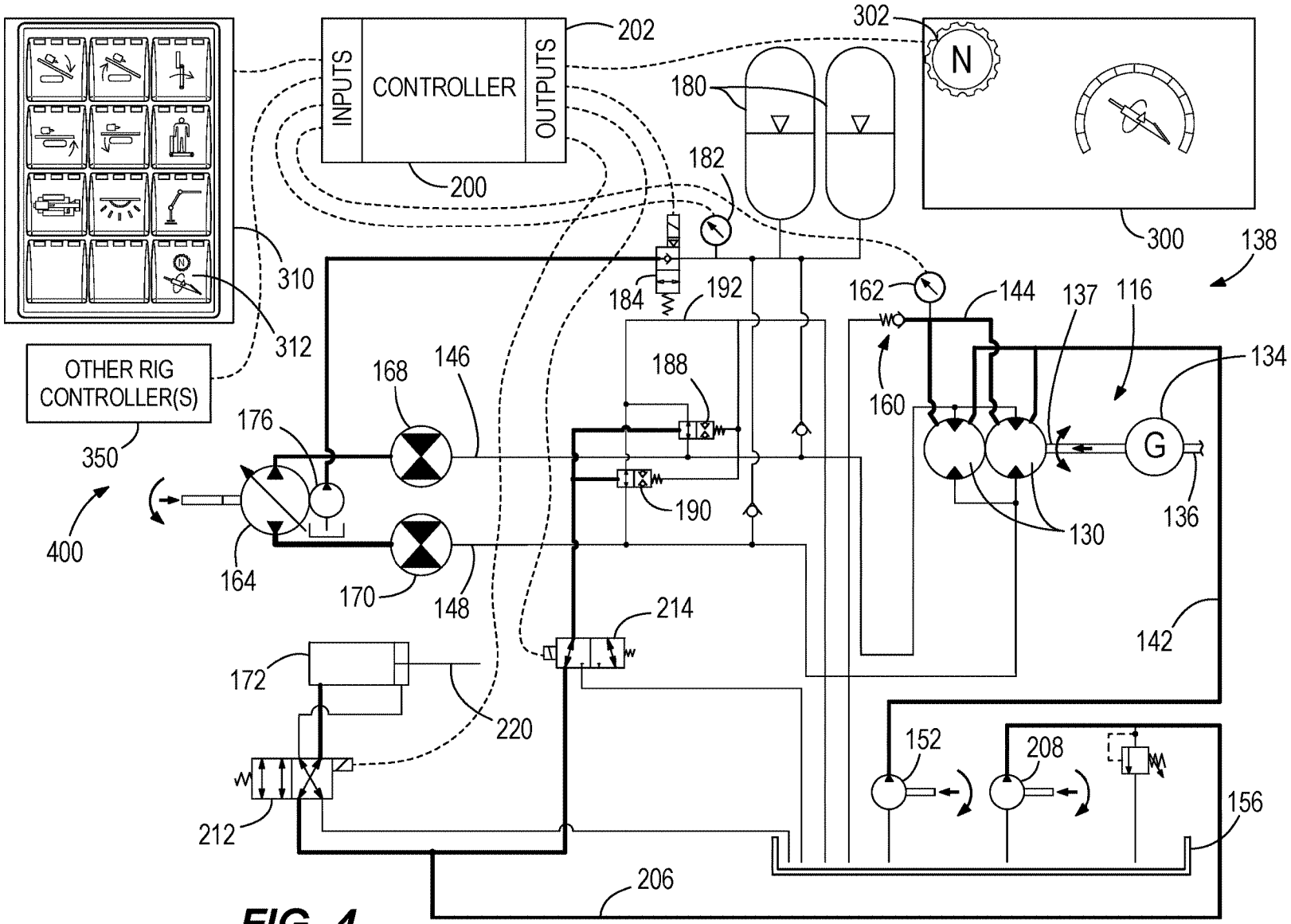
FIG. 4 is a schematic view of the hydraulic system of FIG. 3 in a freewheel mode.
Figure 5:
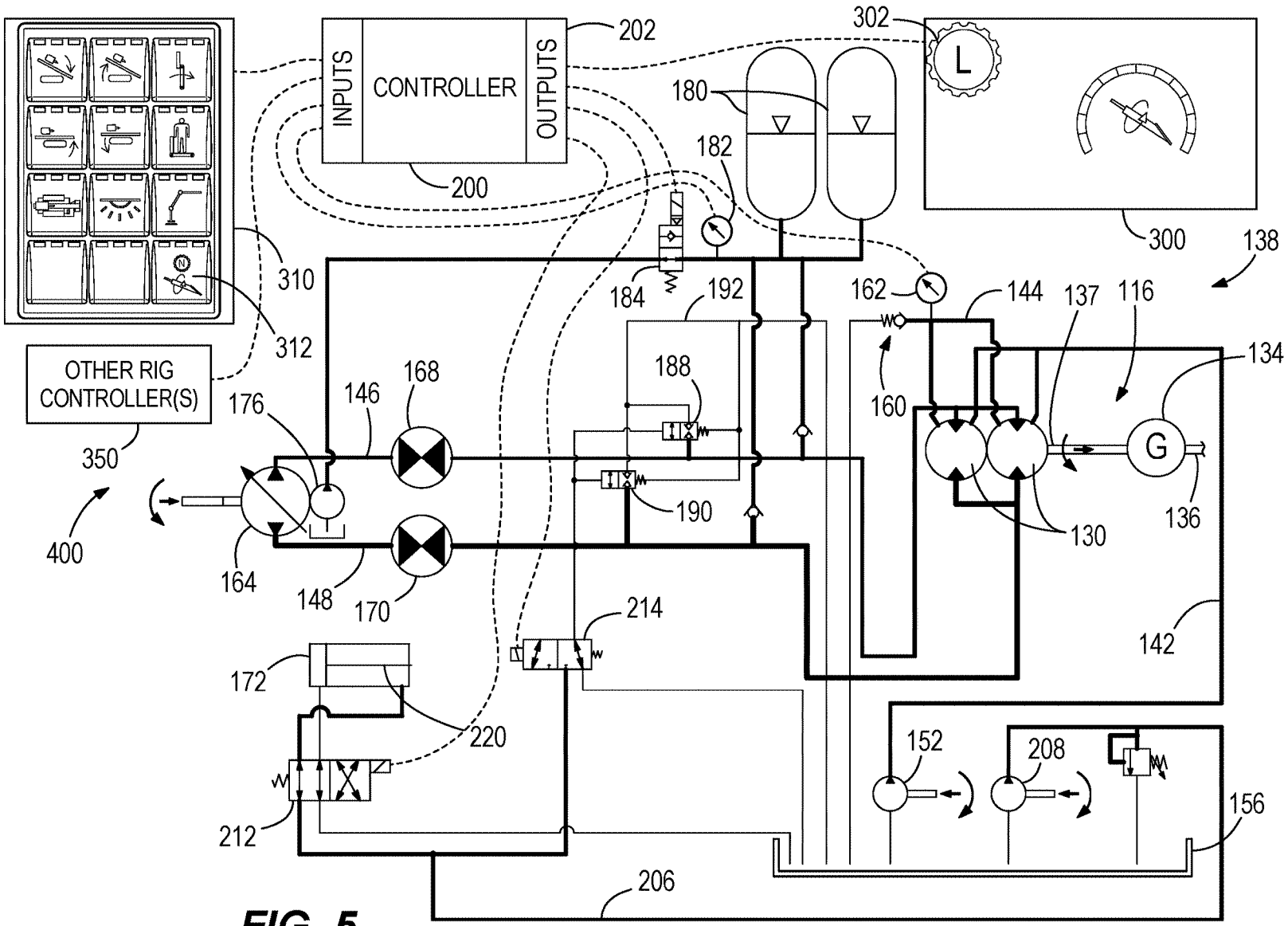
FIG. 5 is a schematic view of the hydraulic system of FIG. 3 in a normal drive mode.

In the illustrated construction, each motor 130 is connected to a flushing line 142, a drain line 144, and a pair of input/output lines 146, 148. The lines 146, 148 may be referred to as system lines or drive lines of the hydraulic circuit 138, and these lines 146, 148 provide fluid flow paths extending between the drive pump 164 and the motors 130. When the hydraulic circuit 138 is placed in a first configuration, as illustrated in FIG. 5, to provide the drive mode, one of the pair of input/output lines 146, 148 provides a first fluid flow path utilized as a high-pressure motor input line while the other of the pair of input/output lines 146, 148 provides a second fluid flow path utilized as a low-pressure motor output line. The drive mode can further be directionally-controlled (forward or reverse), which includes the reversal of which one of the lines 146, 148 receives the output flow from the drive pump 164. The directional control can be provided by an input device, for example in the form of a joystick. The one of the lines 146, 148 acting as the input to the hydraulic motor(s) 130 can carry hydraulic fluid at a pressure of at least 2000 pounds per square inch (psi) (e.g., up to 6000 psi in some constructions). The other one of the lines 146, 148 returns hydraulic fluid back to the low-pressure side of the drive pump 164 at substantially lower pressure. When the hydraulic circuit 138 is placed in a second configuration, as illustrated in FIG. 4, to provide the freewheel mode, the lines 146, 148 between the drive pump 164 and the motors 130 are blocked as described further below. In freewheel mode, the operator input device 310 may be disabled by the controller so as to cause no response in the rotational drive unit 116. References to "high-pressure" and "low-pressure" are used in a comparative sense (rather than referring to particular values or ranges), and with respect to the operation of the drive pump 164, which operates to generate a fluid pressure differential.

The flushing line 142 extends from a flushing pump 152 in fluid communication with a supply of hydraulic fluid, referred to as tank or reservoir 156. The flushing fluid can be provided in a number of ways, this example with a dedicated flushing pump is intended to illustrate the principle. The drain line 144 also extends to the tank 156, which is unpressurized. Thus, hydraulic fluid pumped through the flushing line 142 by the flushing pump 152 passes through the motors 130 and then exits via the drain line 144 to return to tank 156. A spring-actuated check valve 160 is positioned along the drain line 144 and sets a minimum pressure in the lines 142, 144 as the flushing pump 152 operates to drive fluid through the motors 130.

Along the inlet/outlet lines 146, 148, respective rotary ball valves 168, 170 are provided. According to the following disclosure, the rotary ball valves 168 can be actuated separately or in tandem by a single actuator 172 to selectively open and close the inlet/outlet lines 146, 148 between the motors 130 and the drive pump 164. Furthermore, the rotary ball valves 168, 170 are used, to control the flow of hydraulic fluid between the pump 164 and the motor(s) 130, in contrast with a directional control spool valve as would normally be provided for control of the motors 130. A portion of the drive pump 164, or a separate pump, labeled here as 176 can be provided to charge one or more optional hydraulic pressure accumulators 180. The accumulators 180 are connected to the inlet/outlet lines 146, 148 running between the drive pump 164 and the motors 130. The accumulators 180 can be connected to the inlet/outlet lines 146, 148 through respective check valves that only allow fluid flow from the accumulator 180 and not into the accumulator 180. The accumulators 180 are filled with fluid supplied from the pump 176, through an accumulator cut-off valve 184. The accumulator cut-off valve 184 is open only when the inlet/outlet lines 146, 148 are active for driving the motors 130, and the accumulator cut-off valve 184 is closed when the motors 130 are put into the non-driving freewheel mode. In the drive mode, the accumulators 180 provide charge pressure to the motor 130, which is in excess of the back pressure generated by the spring-actuated check valve 160. In the freewheel mode, the accumulators 180 are blocked from fluid supply and allowed to drain to tank 156.

The optional accumulators 180 as well as the inlet/outlet lines 146, 148 are selectively connected to tank 156 through respective switching valves 188, 190 (e.g., "dump valves" or "drain valves") and a drain line 192. If provided, the accumulators 180 operate to reduce the potential for cavitation while the motor 130 is driven by the drive pump 164. The accumulators 180 also dampen fluctuations in the charge pressure that are the result of the charge pressure being used for other purposes, not shown in this schematic. However, they must be drained to enable the case pressure in the motor 130 to retract the pistons for freewheeling. When the valves 188, 190 are opened to drain the accumulators 180 for switching over to freewheel mode, the pressure in the lines 142, 144 is maintained by the spring force of the spring-actuated check valve 160, to be higher than the back pressure generated as the accumulators 180 drain. In other constructions, the control system 138 is provided without the accumulators 180 and without the accumulator cut-off valve 184.

Switching modes of the motors 130 in the illustrated construction is accomplished via the hydraulic control system 138, under the direction of the rotary drive control system 400, e.g., the electronic controller 200 (e.g., microprocessor) thereof. The controller 200 can generate one or more signal outputs via an I/O section 202 in response to a trigger or command, which can come from an operator control (e.g., on the machine or off the machine and wireless connected) operated by a human operator and/or a fully- or semi-automated program executed by the controller 200. In addition to switching of the rotary ball valves 168, 170 (via the actuator 172 which is controlled by valve 212), mode switching includes the switching of the drain valves 188, 190 as well as the accumulator cut-off valve 184, if the accumulators 180 are provided. As illustrated, the controller 200 can provide an electronic signal directly to a solenoid of the accumulator cut-off valve 184. Although independent signals can also be provided to valve 212 to control the actuator 172 and/or to valve 214 to control the drain valves 188, 190 in some constructions such that they are direct-acting valves. The illustrated construction provides for pilot pressure operation, e.g., via a shared pilot pressure line 206 connected to a pilot pressure generated by a pilot charge pump 208 in fluid communication with hydraulic fluid in the tank 156. Pilot pressure can be supplied to a first control valve 212 ("system line shutoff actuation valve") that controls operation (cylinder position) of the actuator 172 and a second control valve 214 ("freewheel enable pilot control valve") that controls operation (switching open) of the drain valves 188, 190, each of which is provided as a two-position, normally-closed, pilot-actuated switching valve. In the case of the first control valve 212, the two positions are configured to control the reversal of which side of the actuator 172 (e.g., double-acting cylinder) is coupled to the pilot pressure line 206 and which side is coupled to tank 156. The second control valve 214 is configured to control whether the drain valves are coupled to tank 156 or coupled to the pilot pressure line 206. Although valves for larger flow capacity have larger spools and require higher forces to operate (such that larger valves tend to be pilot operated), it is contemplated for the disclosed valves to be either direct-acting or pilot-operated, regardless of what is described and shown explicitly.

Figure 9:
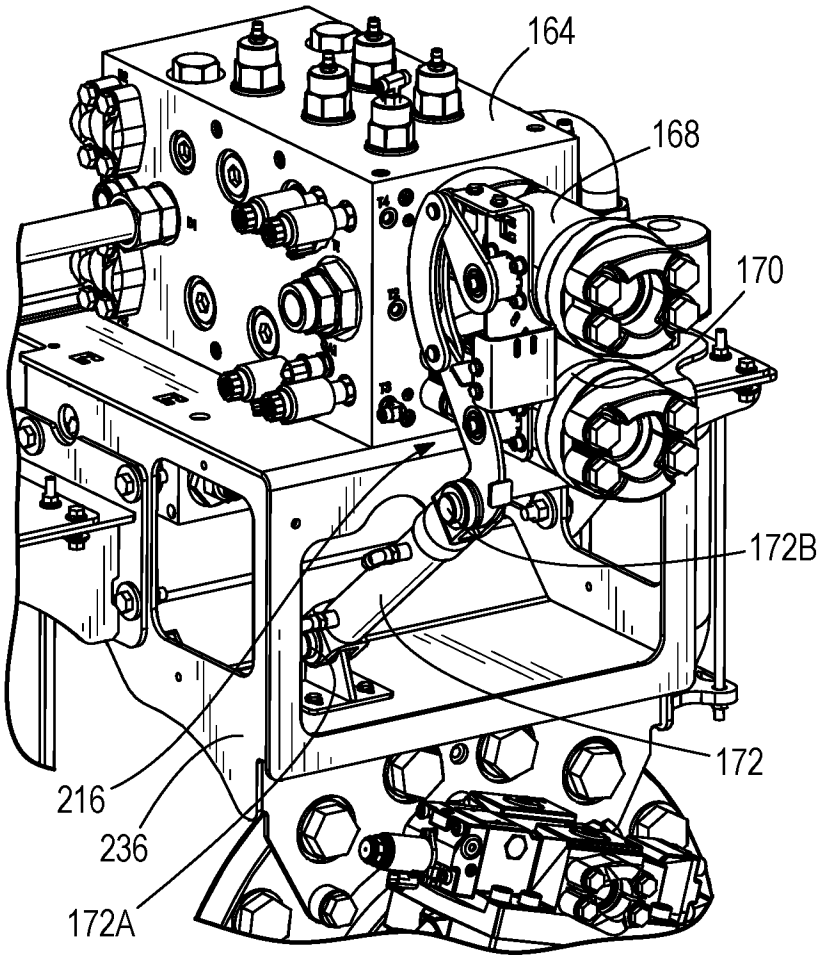
FIG. 9 is a perspective view of the actuator, linkage and rotary ball valves mounted on a frame of the HDD rig.
Figure 8:
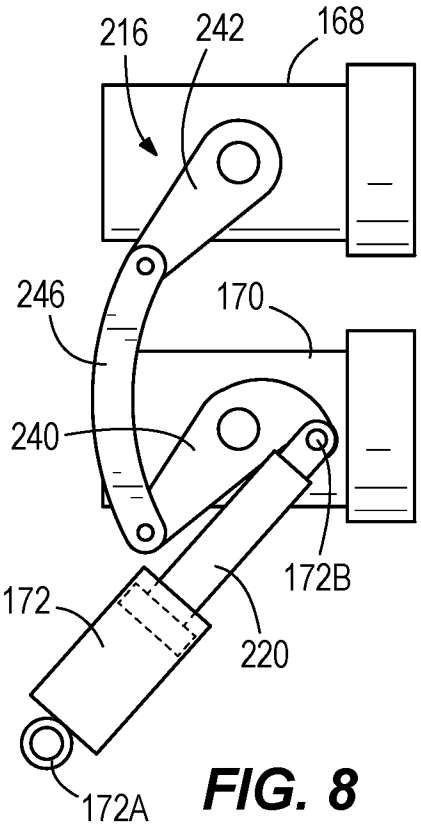
FIG. 8 is a side view of the actuator and linkage shown in second positions corresponding to a second position of both rotary ball valves.
Figure 7:
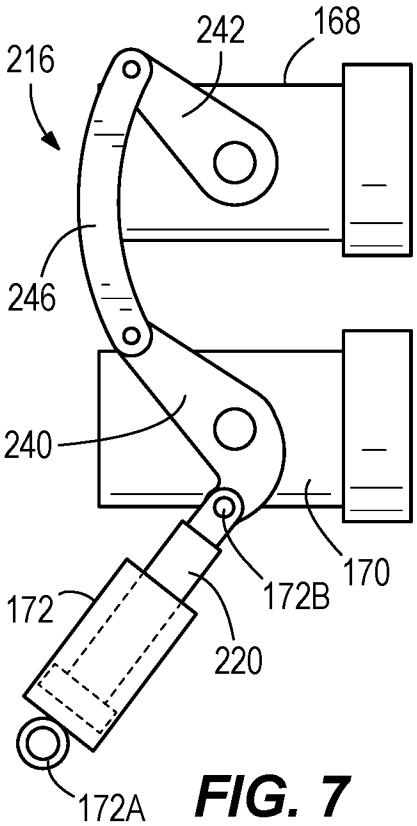
FIG. 7 is a side view of a set of rotary ball valves jointly controlled to open and close by an actuator and linkage. The actuator and linkage are shown in first positions corresponding to a first position of both rotary ball valves.

As illustrated in FIGS. 7-9, the actuator 172 for the rotary ball valves 168, 170 can be coupled to a linkage 216 for concurrently actuating both rotary ball valves 168, 170 (both open—FIG. 7; or both closed FIG. 8). The first and second control valves 212, 214 have separate branch lines from the pilot pressure line 206, and both have connections to tank 156 via respective drain lines. The first and second control valves 212, 214 are coupled with the controller 200 to receive electronic signals therefrom—thus, controlling their positional state and whether or not the rotary ball valve actuator 172 and the drain valves 188, 190 are in the actuated/energized state or an at-rest state. The same pilot pressure line 206 on the one hand supplies pilot pressure for actuating pilot-actuated valves (drain valves 188, 190), and on the other hand supplies actuating pressure to the rotary ball valve actuator 172 (e.g., retracting the piston rod 220). The actuator 172 is depicted as a hydraulic cylinder for actuating the rotary ball valves 168, 170 through the exemplary linkage 216 as described above. This is one example of a linear actuator. However, it is also contemplated that the actuator 172 is replaced with one or more electric actuators. In other constructions, the ball valves 168, 170 are configured to be actuated by one or more rotary actuators. The actuator(s), regardless of type, can be configured to operate the ball valves 168, 170 either with or without the connecting linkage 216.

Figure 6:
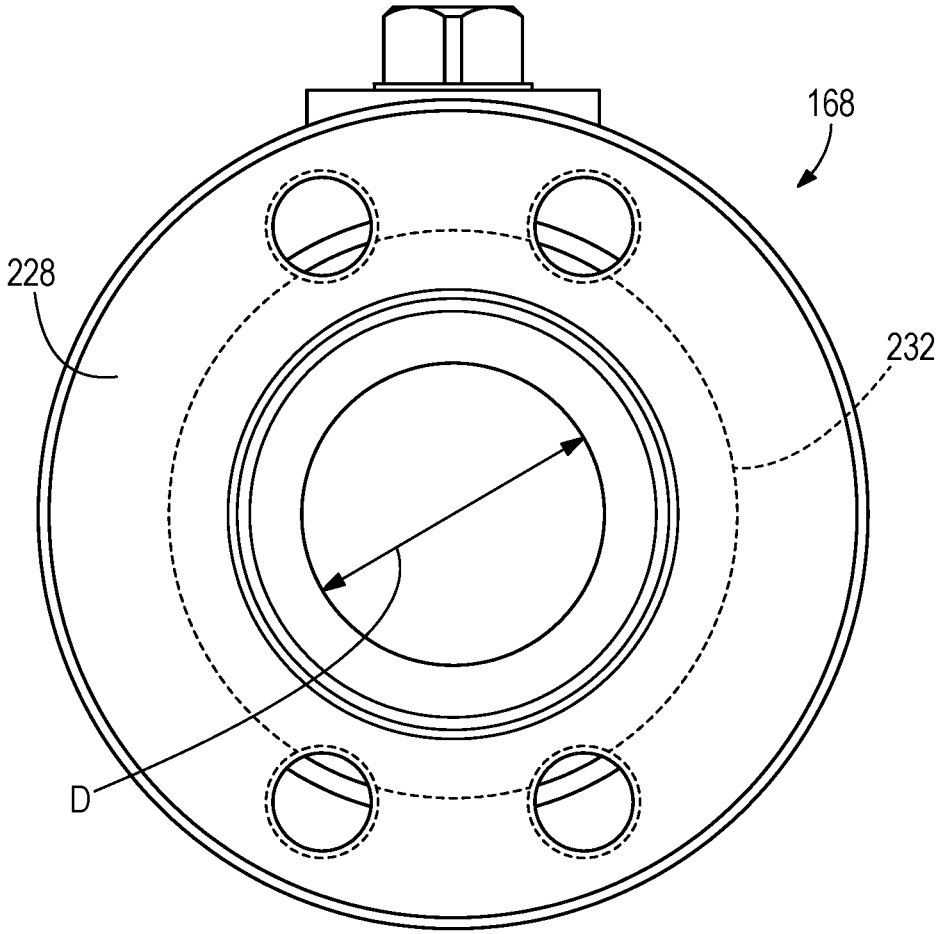
FIG. 6 is an end view of a rotary ball valve of the hydraulic system.

Several detailed features of parts of the hydraulic control system 138 are described with reference to FIGS. 6-9, before describing methods of operation. FIG. 6 is an end view of one of the rotary ball valves 168. It is noted that the second rotary ball valve 170 can have an identical structure, or at least share the features described explicitly herein. The rotary ball valve 168 can have a connection structure for making a secure, sealed connection with the hoses, pipes, etc. that are used to make up the first inlet/outlet line 146. Although various types of connection structures can be utilized, FIG. 6 illustrates a bolting flange 228. Such flanges can be used at one or both ends of the rotary ball valve 168. Four bolt holes are provided through the flange 228, but other configurations are possible. The rotary ball valve 168, including the movable ball element 232 therein, defines a flow-through diameter (D). The rotary ball valve 168 is shown with the movable ball element 232 in the open position. The diameter (D) can match an internal diameter of the first inlet/outlet line 146. When the rotary ball valve 168 is open, there is substantially no difference in flow restriction along the first inlet/outlet line 146 between the drive pump 164 and the motors 130 as compared to the first inlet/outlet line 146 extending directly between the drive pump 164 and the motors 130 without the rotary ball valve 168. In other words, the presence of the rotary ball valve 168 as the element responsible for opening and closing the first inlet/outlet line 146 between the drive pump 164 and the motors 130 is negligible in regard to pressure drop calculations when open and the motors 130 are being driven by the drive pump 164. This is in stark contrast to a conventional directional control spool valve, which—although compact and typically quicker in changing states—would impose a quantifiable and significant pressure drop along the first inlet/outlet line 146. The same type of relationship and performance can exist for the second rotary ball valve 170 with respect to the second inlet/outlet line 148 along which it is situated.

FIGS. 7-9 illustrate an exemplary physical arrangement for the rotary ball valves 168, 170 along with the actuator 172 operable to switch the rotary ball valves 168, 170 between their open and closed positions, e.g., synchronously, or at least concurrently via the aforementioned linkage 216. FIG. 9 illustrates that the two rotary ball valves 168, 170 can be arranged in a stacked positional arrangement such that the rotary axes for operating the valves 168, 170 are parallel and offset (e.g., vertically offset, with no horizontal offset). Other positional relationships are optional. The rotary ball valves 168, 170 can be connected directly to the drive pump 164, which in turn is supported on a pump frame 236, which can be a portion of a main frame of the HDD machine 100B, or a separate bracket or frame fixedly secured thereto. The actuator 172 has a first end 172A anchored (e.g., pinned to a clevis or other pivotal anchor structure) to the pump frame 236. A second end of the actuator 172B is pivotally coupled to a valve link 240 that is fixed for rotation with the ball of one of the rotary ball valves 168, 170 (e.g., the nearest one of the rotary ball valves—in this case the second rotary ball valve 170). The actuator 172 can be a linear actuator having the piston rod 220 that selectively retracts and extends in response to the switching of the first control valve 212, and the valve link 240 is configured to rotate in response to the retraction and extension of the piston rod 220. The first rotary ball valve 168 has a similar valve link 242 fixed for rotation with its ball. The two valve links 240, 242 are coupled together via a connector link 246 such that rotation of the valve link 240 connected to receive the movement of the actuator 172 results in rotation of the other valve link 242. Through the connector link 246, the two valve links 240, 242 may rotate through equivalent angular ranges with the result that the actuator 172 extending or retracting causes both rotary ball valves 168, 170 to go all the way from the closed position to the open position or vice versa.

In an alternate construction, the drain valves 188, 190 can be actuated to open without provision of the second control valve 214 (e.g., only the first control valve 212 is provided). For example, the pilot pressure for actuating the drain valves 188, 190 can be provided from the line that supplies pressure from the first control valve 212 to actuate the actuator 172 in FIG. 4. In such a construction, the pilot lines to the drain valves 188, 190 would be in fluid parallel with the actuator 172, on the same side of the first control valve 212.

In operation, the first HDD machine 100A is operated to build up the drill string 104 and drill underground toward the second HDD machine 100B. Once the head of the drill string 104 protrudes from the ground at the second HDD machine 100B, the back reamer 108 is attached to the drill string 104, and the tail string 112 is built up one rod at a time from the second HDD machine 100B. Similar to the drill string 104, the tail string 112 can include sequential rods joined with respective threaded joints. Making up joints between rods of the tail string 112 includes use of the rotational drive unit 116 to apply torque to the rod being added to the tail string 112. During this process, the tail string 112 is held fixed by a vise on the second HDD machine 100B, and the rotational drive unit 116 can also slide as necessary along the rack 120 to allow the rods to join axially during threading. Because torque to the tail string 112 is required during joint making, the motors 130 are in the first or drive mode (FIG. 5). Once the new tail string rod is added and reaming is to commence, the motors 130 can be switched into the second or freewheel mode (FIG. 4). Although various alternatives are described above, this transition can be accomplished by sending a signal from the controller 200 to the first and second control valves 212, 214 as well as the accumulator cut-off valve 184. The first control valve 212 causes the actuator 172 to switch states (e.g., retracted to extended) via supply of hydraulic fluid from line 206. This occurs through manipulation of the linkage 216 as shown in FIGS. 7 and 8, and results with the rotary ball valves 168, 170 being rotated to close. The same line 206 provides pilot pressure to the drain valves 188, 190 upon switching of the second control valve 214 such that the inlet/outlet lines 146, 148 between the drive pump 164 and the motors 130 are drained to tank 156 via the drain line 192 that is connected via the opened drain valves 188, 190. Upon disconnection from the drive pump 164, the case pressure prevails inside the motors 130, and the pistons all retract radially inward so that the rotor in each motor becomes incapable of applying positive or negative torque to the tail string 112, and is instead "freewheeling" to follow the rotation of the tail string 112 as the tail string 112 rotates under the influence of the first HDD machine 100A and the drill string 104 connected thereto. During freewheeling, the movement of the rotational drive unit 116 along the rack 120 can be controlled, by way of controlling the carriage drive system 500 (FIG. 13), to provide a longitudinal force in either direction. The force applied to the tail string 112 has been found to affect the reaming operation; for instance, in some cases the downward movement of the rotational drive unit 116 along the rack 120 is resisted, generating a tensile load in the tail string 112 which will tend to lift the reamer 108. In other cases, the carriage drive system can urge the rotational drive unit downward generating a compressive load in the tail string 112, to apply an additional longitudinal force to the reamer 108. Once the full stroke of the second HDD machine 100B is realized and a new rod is to be added to the tail string 112, the motors 130 are switched back to the drive mode (FIG. 5) by signals from the controller 200 to reverse the states of the first and second control valves 212, 214 and the accumulator cut-off valve 184. The process may be repeated over and over until the reaming operation is complete, i.e., the reamer 108 reaches the entry opening at the first HDD machine 100A.

While the descriptions of freewheeling herein can refer to (hydraulically or otherwise) setting the rotational drive unit 116 to a configuration disabled from generating torque, it is also noted that freewheeling is but one optional method of setting the rotational drive unit 116 to act as a slave or follower, wherein the output of the rotational drive unit 116 is rotated passively from the drill string (e.g., tail string 112). For example, the rotational drive unit 116 may remain in a regular or modified torque-transmitting configuration, despite the rotational drive unit contributing substantially nothing to the drill string rotation, and in some cases actively opposing the drill string rotation. Except where it would be explicitly contradictory, descriptions of freewheeling throughout the present disclosure should be understood to also apply more generally to slave or follower operation of a rotational drive unit 116.

The rotary drive control system 400 includes a display device 300 for communicating the status of the HDD machine 100B to an operator, an operator input device 310 for allowing an operator to select modes of operation, and control algorithms for operating the machine, including the rotational drive unit 116, in coordination with other machine controllers 350 of the HDD machine 100B, to automate and coordinate various operations.

Figure 10A:
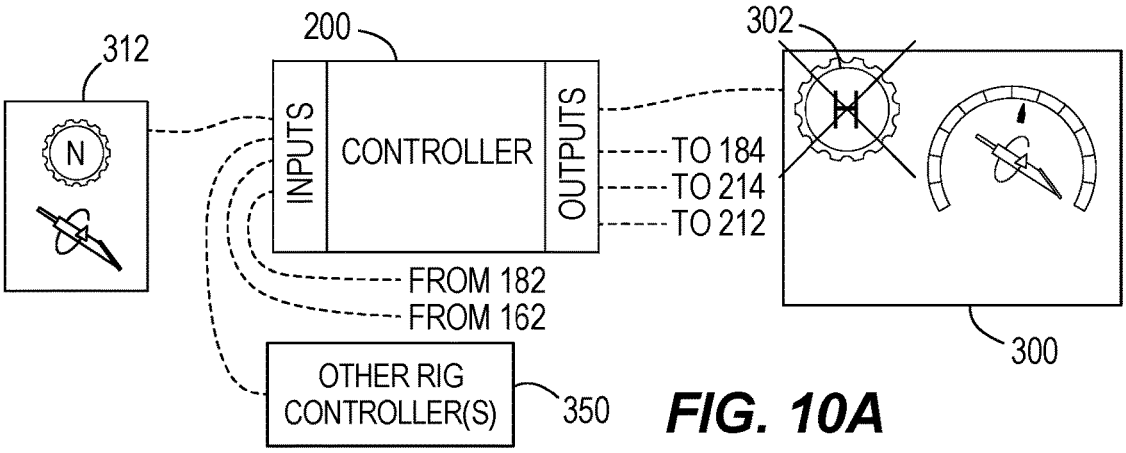
FIG. 10A is an illustration of the control system in a normal mode.

The operator input device 310, shown schematically in FIGS. 3-5, includes a control that the operator can activate to affect or select the operating mode, such as to toggle between the normal mode and the freewheel mode. This control could be any type of device that is reasonable for the operator to utilize. The embodiment illustrated in FIG. 10A includes an input device 310 that is a push-button switch ("button 312") that closes a circuit when an operator is pressing it, and opens the circuit when the operator is not pressing it. The control logic included in the controller 200 includes an algorithm that monitors the status of the electrical circuit connected to the button 312.

If the control button 312 is depressed for a predetermined period of time, while the HDD rig 100B is in normal operation mode, the controller 200 will recognize that the operator wishes to switch to the freewheel mode. The controller 200 will evaluate the other rig controller functions to ensure:

1) that the rotary drive 116 is not currently rotating: to avoid damage, motor cannot be rotated during the transition from normal to freewheel mode;
2) that the operator control for rotation is not being used, such as a joystick control lever is in its neutral position;
3) that an operator is present, by monitoring an operator presence sensor;
4) that the rig is not locked-out—such as with a Remote Lockout System as described in U.S. Pat. Nos. 6,766,869 and 6,408,952 that are hereby incorporated by reference;
5) and it may further require the vises of the rig be in the open position.

Figure 10B:
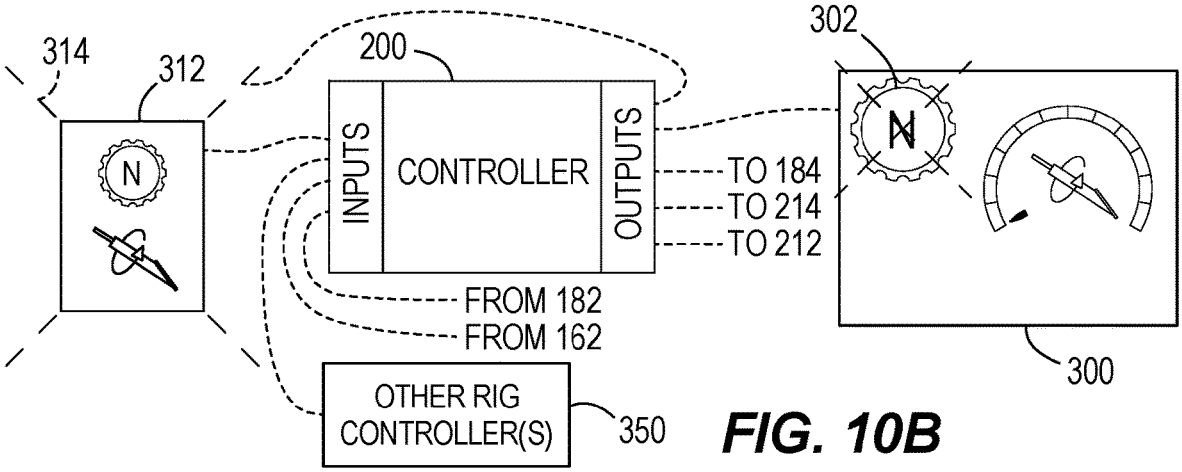
FIG. 10B is an illustration of the control system in transition for freewheel.

Once the controller 200 confirms these conditions it will initiate the process to switch to the freewheel mode, e.g., including control of the rotary ball valves 168 and 170, the control valves 212, 214, and the accumulator cutoff valve 184, as is described above. With the hydraulic system described herein, this process may take two seconds or more, such as three to four seconds, and the time required for this process may be affected by the temperature of the hydraulic oil. Rotation of the output member 136 of the rotary drive 116 during this transition period can potentially damage the motor(s) 130, thus the operator of the second HDD machine 100B should be provided a clear indication of the status of the mode change, so that the operator can communicate effectively and efficiently with the operator of the first HDD machine 100A. The indication of the status of the mode change is provided by the rotary drive control system's transition mode, which can include one or more means of transitional display, e.g., illustrated as FIG. 10B with operator display 300 and a with a light 314 integrated with the control button 312. The display 300 includes a rotational drive unit status indicator 302. The control button 312 in one embodiment is a switch selectively illuminated by the light 314, which for the purposes of the drawings is indicated schematically as an X-shaped pattern emanating from the button 312. When the controller 200 recognizes that the operator wishes to switch to freewheel mode, after the control button 312 is pressed for two seconds, the light 314 causes the control button 312 to flash during the transition period, as indicated by the broken lines of FIG. 10B emanating from the control button 312. During this time, the indicator 302 will change to display a flashing symbol "N" for neutral, as an indication that the rotational drive unit 116 is transitioning to the freewheel mode. Neutral can be the on-machine designation of the freewheel or follower mode described herein. The dashed lines of FIG. 10B are used to schematically illustrate that the display 302 is flashing. Thus, the rotary drive control system 400, along with the controller 200, has a designated transition mode that operates in a discrete manner from the control modes corresponding to the normal and freewheeling modes, even though the transition mode does not provide a discrete function for the rotational drive unit 116, other than allowing it to change between the functional modes, while providing specific indication to the operator.

Figure 10C:
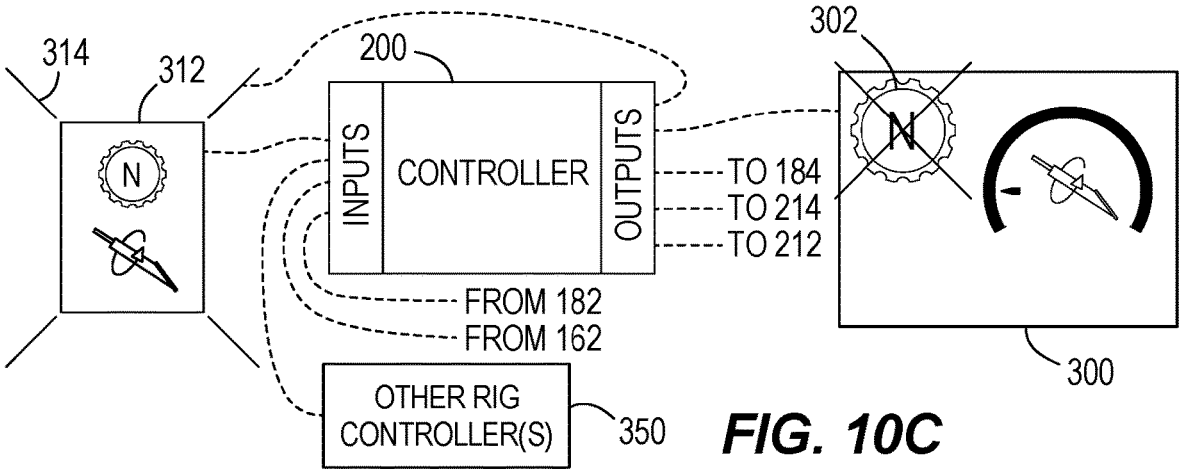
FIG. 10C is an illustration of the control system in a freewheel mode.

The rotary drive control system 400 will monitor the HDD machine 100B, including, in the illustrated hydraulic embodiment, the charge pressure with sensor 182 and the case pressure with sensor 162 and the position of the rotary ball valves 168, 170 with proximity switches (that are not shown). Once the control system 400 confirms that the charge pressure has dropped to a predetermined low pressure, and that the case pressure is more than the charge pressure, and that the rotary ball valves 168, 170 are in the second position, it will determine that the system is in the freewheel mode. At that point, the light 314 of the control button 312 will stop flashing, and it will be illuminated continuously. The status indicator 302 will also stop flashing, the symbol "N", as illustrated in FIG. 10C. The way that the indicator 302 is displayed communicates that the machine has completed the transition to the freewheel mode, such as by being on continuously and to be illuminated as green. The operator of this machine, the second HDD machine 100B, will be in communication with the operator of the first HDD machine 100A during this process, to communicate information about this mode change.

Other types of hydraulic systems that could be utilized to provide a freewheel mode will also require a transition period between modes. Thus, the control system described herein has utility for the hydraulic system described herein, but it also has utility with other hydraulic systems. In addition, if the rotary drive unit 116 is powered by an electric motor rather than a hydraulic motor, the system may still operate with a normal driving mode and separate freewheel or follower mode, and may also incur a transition period for mode changing. Thus, the control system 400 described herein has utility with an electric drive system. An electric rotary drive unit can be set to follower mode by ceasing energization or a small, controlled energization that is largely or completely imperceptible to the HDD machine 100A driving the drill string 104 and the tail string 112. Whether de-energized or only slightly energized, the follower mode of the electric rotary drive unit allows the rotary drive unit output to be passively rotated from the rotation of the tail string 112, similar to a hydraulic motor configured in a torque-disabled freewheel setting. The fact that this disclosure describes in greatest detail the context of one type of hydraulic drive system, is not necessarily limiting.

In addition to controlling the hydraulic system 138, the controller 200 can be configured to affect other systems of the exit side HDD machine when in the freewheel mode. In some embodiments, the controller 200 can affect the operation of the carriage drive system 500. In one embodiment, the controller 200 affects the operation of the carriage drive system 500 when in the freewheel mode, to only apply a pulling force onto the reamer. In another embodiment, the controller can affect the automatic control of the carriage drive system so that the function of that system is optimized for the freewheel mode.

If the button 312 is depressed for a predetermined period of time, while the HDD rig 100B is in freewheel mode, the controller 200 will recognize that the operator wishes to switch to the normal mode. The controller 200 will evaluate the other rig controller functions to ensure:

1) that the rotary drive 116 is not currently rotating: to avoid damage, the motor cannot be rotated during transition from freewheel to normal mode;
2) that the operator control for rotation is not being used, such as a joystick control lever is in its neutral position;
3) that an operator is present, by monitoring an operator presence sensor;
4) that the rig is not locked-out.

Once the controller 200 confirms these conditions it will initiate the process to switch to the normal mode, e.g., by control of the rotary ball valves 168 and 170, control valves 212 and 214, and accumulator cutoff valve 184. This process may include staggered activation of these various devices. For instance, it has been discovered that with the hydraulic system described herein, if the rotary ball valves 168, 170 are opened before the accumulator cutoff valve 184 is opened, a pressure spike will be generated by the in-rush of hydraulic fluid. Thus, in one embodiment the accumulator cutoff valve 184 is opened first, while the ball valves 168, 170 are opened slightly later. Thus, this process may take two seconds or more, for example seven seconds. With cold oil temperature, this process may take even longer than seven seconds to complete, for example up to 30 seconds. Rotation of the output member 136 of the rotary drive unit 116 during this transition period will potentially damage the motor(s) 130, thus the operator of the second HDD machine 100B should be given a clear indication of the status of the mode change, so that the operator can communicate effectively and efficiently with the operator of the first HDD machine 100A. The indication of the status of the mode change is provided by the display 300 and the display device (light 314) integrated with the control button 312. When the control unit 200 recognizes that the operator wishes to switch from freewheel to the normal drive mode, after the control button 312 is pressed for two seconds, the light 314 of the control button 312 will flash during a transition period. During this time, the indicator 302 will change to display a flashing symbol "N", representing neutral, as an indication that the rotational drive unit 116 is transitioning from the freewheel mode. The indicator 302 may also be illuminated as yellow during this transition period.

The control system 400 will monitor the charge pressure with sensor 182. Once the system confirms that the charge pressure has reached a predetermined pressure and it that the ball valves 168, 170 are in the first position, it will determine that the system is safely in the normal mode. At that point the light 314 of the control button 312 will stop flashing, and it will be turned off. The indicator 302 will also stop flashing the symbol "N", and a different symbol will be on continuously, a symbol indicating the status of the rotary drive, such as "L" for low speed, "M" for medium speed, or "H" for high speed. Other symbols can be used to indicate that status of the rotary drive unit 116, such as numbers like 1, 2, 3, or 4. The indicator 302 could be illuminated as green at this point. The operator of this machine, the second HDD machine 100B, will be in communication with the operator of the first HDD machine 100A during this process, to communicate information about this mode change.

Figure 13:
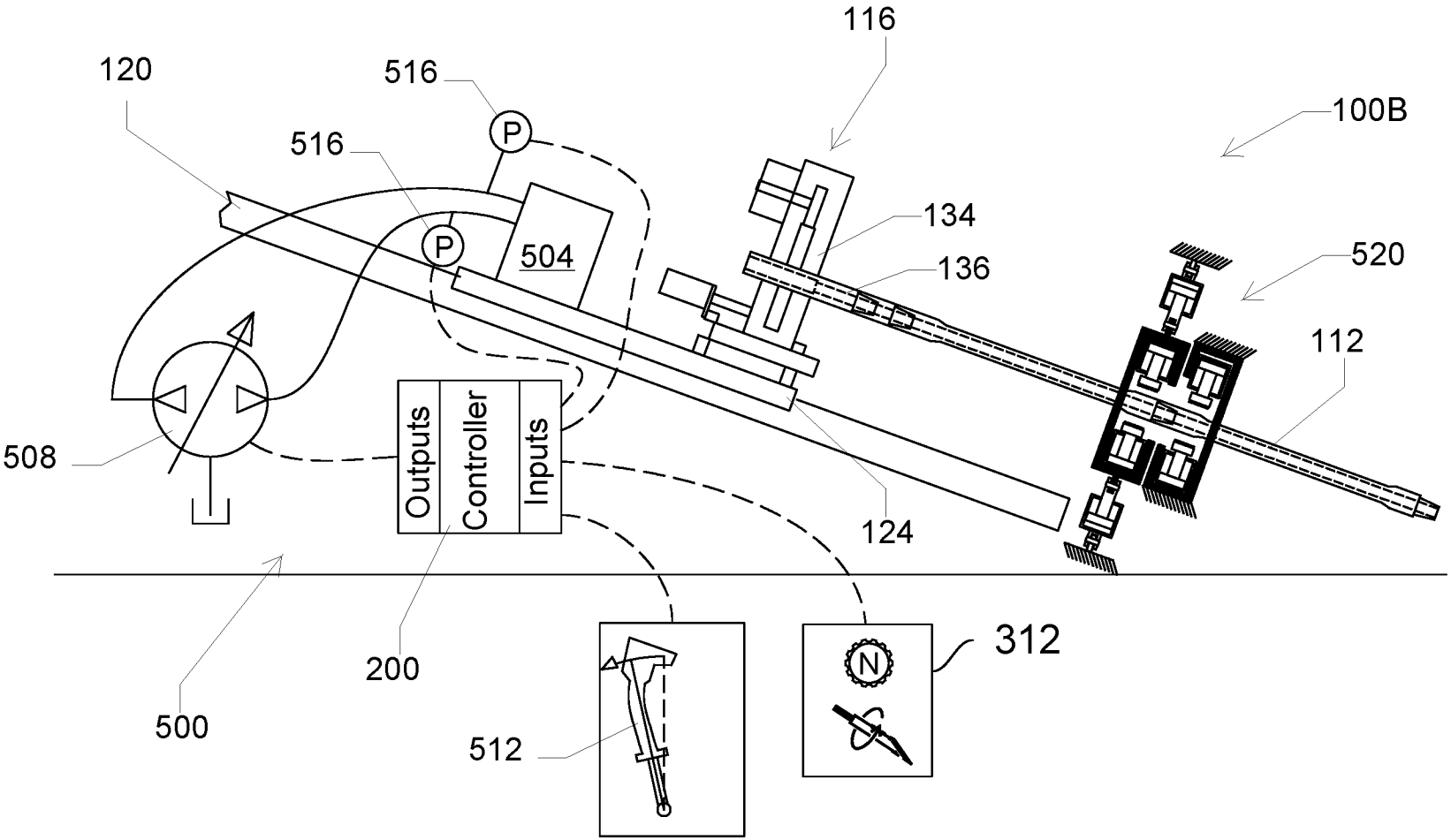
FIG. 13 is an illustration of a carriage drive control system that provides two disparate control modes for the joystick thereof. The joystick is shown in a pulled back position for controlling tension on the drill string.

In addition to the processes defined for manual selection of a mode, by the operator, the control system 400 includes logic for a suspend mode or "freewheel suspend," which is a mode that the controller 200 automatically switches into and out of. The suspend mode can be accessed exclusively when set or commanded into the freewheel mode by the operator and can switch automatically back and forth to/from the freewheel mode. While in the freewheel mode, the freewheel suspend mode is automatically initiated, or entered into, whenever an operator uses a machine control to clamp the drill rod (tail string 112) with a vise 520 and is automatically exited when an operator uses a machine control to release the vise 520. As shown in FIG. 13, the vise 520 has two sections for clamping each of two sequential drill rods (or one drill rod and the rotational drive unit output member 136). Furthermore, the HDD machine 100B will enter the freewheel suspend mode, rather than achieving the freewheel mode, when the operator selects the freewheel mode while the vise 520 is clamped rather than open, according to the program of the control system 400. Subsequently, the machine will automatically transition to the freewheel mode upon the control system 400 determining that the vise 520 is not clamped.

Figure 11A:
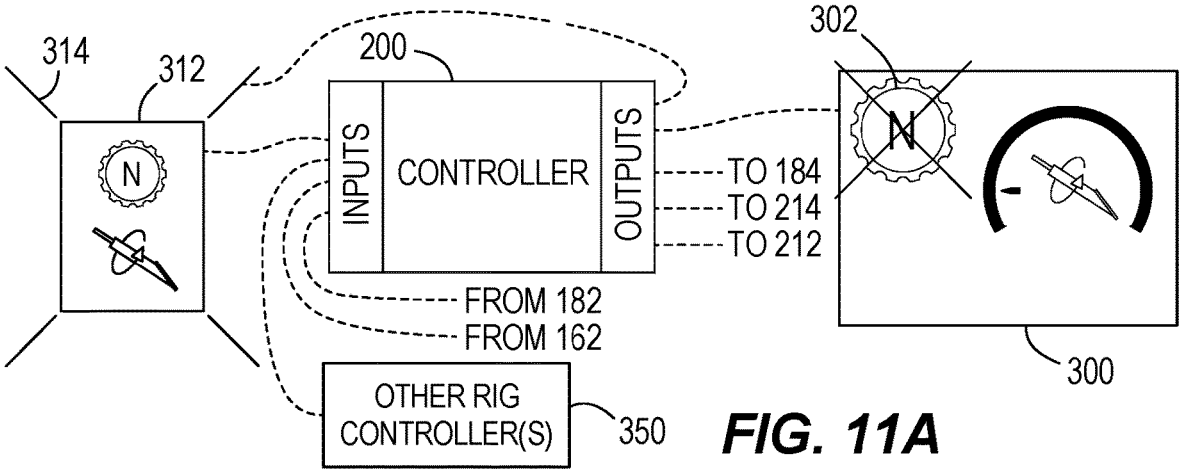
FIG. 11A is an illustration of the control system in a freewheel mode.
Figure 11B:
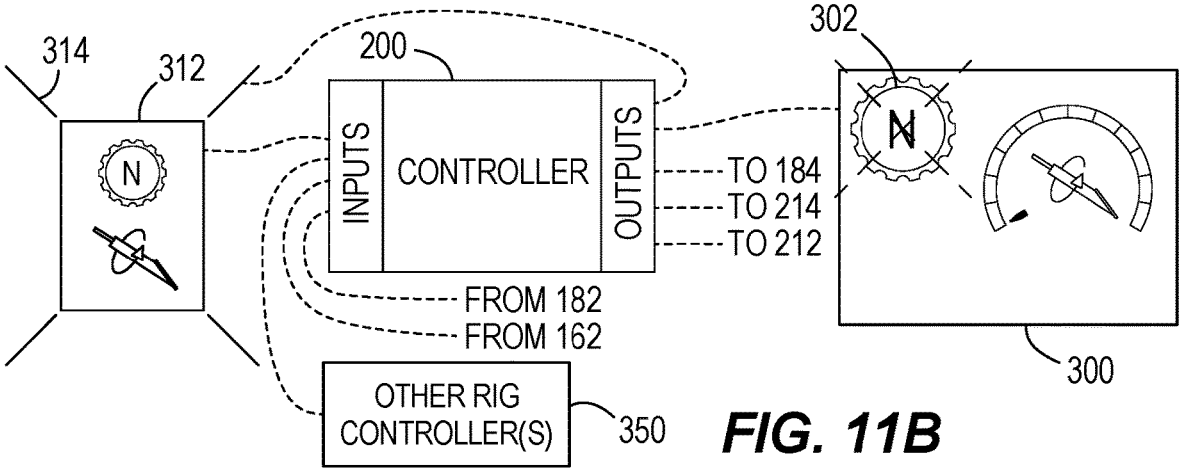
FIG. 11B is an illustration of the control system in transition for suspend.
Figure 11C:
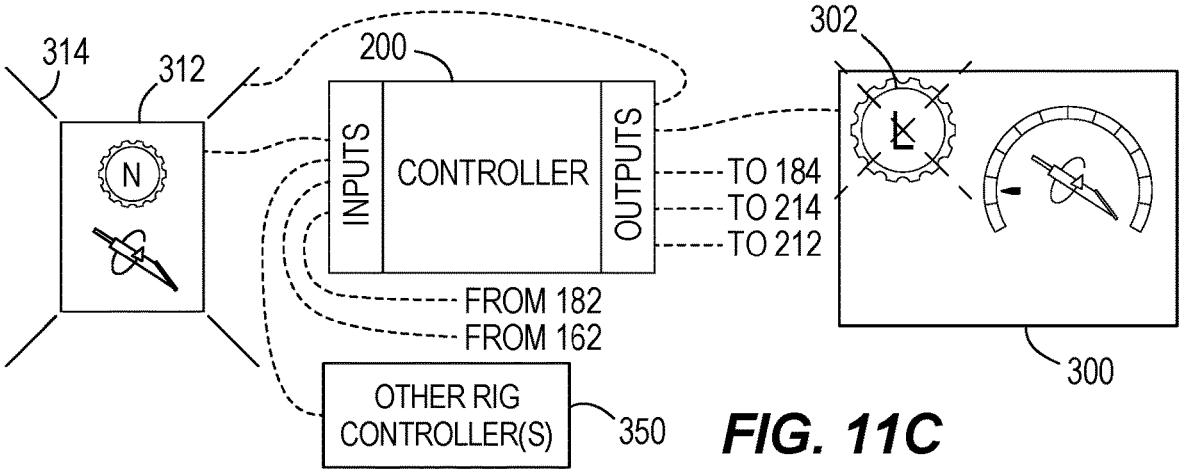
FIG. 11C is an illustration of the control system in a suspend mode.

The operator of the second HDD machine 100B will use the vise control when a drill rod in the tail string 112 has been pulled into the bore hole far enough that a joint between the drill rod and the rotary drive unit 116 is positioned at the vise 520. When that occurs, the operator at the second HDD machine 100B will communicate with an operator at the first HDD machine 100A, to request that the first machine interrupt the pull-back process. The operator of the first HDD machine 100A will stop its thrust and rotary drive systems which are powering the drill string 104 and the reamer 108. Once the drill string 104, the reamer 108, and the tail string 112 stop, the operator of the second HDD machine 100B will clamp the tail string 112 with its vise 520, as a first step in the process to add a drill rod to the tail string 112. This requires the rotary drive unit 116 to be unthreaded at that joint. Once unthreaded, the operator will retract the rotary drive unit 116 back, making room for a new drill rod to be added to the tail string 112, the processes associated with unthreading the rotary drive unit 116, moving it back along the rack of the second HDD machine 100B, and then attaching a new drill rod involve normal use of the rotary drive and thrust systems. In order to minimize required operator input, and to speed-up the overall process, the control system 400 will automatically switch from the freewheel mode to the freewheel suspend mode, which is a momentary limited drive mode, in response to the vise 520 being clamped while the machine is in the freewheel mode. This automatic switch in the modes further includes a transition phase, where the machine is transitioning from freewheel to the freewheel suspend mode, which provides the drive capability for the rotary drive unit 116 to complete the drill rod addition. The change in the display is illustrated by comparison of FIG. 11A, which illustrates the display indicating the freewheel mode, and FIG. 11B which illustrates the display indicating the transition to the freewheel suspend mode. This transition phase is important, to make sure that the rotary drive system is not actively used which could damage the motors 130. When the vise 520 is first clamped, the control system 400 includes a display that informs the operator that the machine 100B is in a transition phase, during which the machine should not be operated. This is indicated by maintaining illumination of the control button 312 (by the light 314), and by changing the indicator 302 from a continuous display of the symbol "N", to an intermittent or flashing of the symbol "N". This flashing symbol "N" could additionally be illuminated in yellow. After a predetermined period of time, or after evaluation of measured machine parameters, the control system 400 can verify that the machine 100B is completely in the freewheel suspend mode, where the operator can safely operate the machine, including the rotary drive unit 116, to add a rod. The display will change, informing the operator of this status as shown in FIG. 11C: the control button 312 for the freewheel control will remain illuminated by the light 314, and the indicator 302 will change to an intermittent or flashing display of the symbol "L" indicating to the operator that the rotary drive will function in Low speed corresponding to the maximum motor displacement, which is the mode used for breaking and making joints between drill rods. The symbol "L" could additionally be illuminated as yellow at this time, to indicate to the operator that it is not the normal Low mode.

The control system 400 may automatically disable some operator controls during the transition phase, to ensure that an operator does not make a mistake and operate the machine systems during the transition. The display will clearly inform the operator of the second HDD machine 100B that it is in a transition phase, so that information could be communicated to the operator of the first HDD machine 100A, to reduce the potential that the operator of the first HDD machine 100A would do anything to cause the tail string 112 to rotate.

This automated process will eliminate the need for an operator to separately activate the freewheel mode control 312 and fully exit freewheel mode when the vise 520 is clamped, which would otherwise be necessary, in order to switch to normal mode, so that the machine systems could be operated to add a rod to the tail string 112. Due to the automatic and momentary nature of the freewheel suspend mode, the freewheel suspend mode is differentiated from normal drive mode. Even though the rotary drive unit 116 is enabled and used for limited driving during the freewheel suspend mode, the rotary drive unit 116 is only operable on the final drill rod, not the entire tail string 112, and the HDD machine 100B otherwise remains "set" to the freewheel mode since the suspend mode is an automatic subroutine that occurs when the HDD machine 100B is set to the freewheel mode.

While in the freewheel suspend mode, the operator will add a drill rod to the tail string 112. After a drill rod is added, it will be natural for the operator of the second HDD machine 100B to release the vise 520. This release of the vise 520 will trigger the control system 400 to automatically initiate a transition to the freewheel mode (i.e., freewheel mode no longer suspended). The transition can cease the drive capability of the freewheel suspend mode to return to freewheel mode. Once the second HDD machine 100B is back in freewheel mode, the pullback process can be restarted. As was noted previously, the rotary drive unit 116 should not be rotated while the machine is transitioning into the freewheel mode. Thus, the process of switching from the freewheel suspend mode back to the freewheel mode, includes a transition phase during which there is a clear indication for the operator of the second HDD machine 100B. After the vise 520 is released, the control system 400 includes a display that informs the operator that the machine is in a transition phase, during which neither the first nor the second HDD machines should be operated. After completing a process defined by logic in the controller 200, such as after a predetermined period of time after the vise 520 is released, or after confirmation that certain measured machine parameters meet predetermined levels, the display will change to inform the operator that the second HDD machine 100B is in the freewheel mode, and the first HDD machine 100A can safely re-start the pullback process. The transition phase is indicated to the operator with the display 302 that was previously intermittently displaying a symbol "L" now intermittently displaying or flashing the symbol "N". After a predetermined time, and/or after confirming feedback signals from system, the system will indicate that it is safely in the freewheel mode by displaying a solid "N" illuminated in green. Once that mode is confirmed, the operator of the second HDD machine 100B will communicate with the operator of the first HDD machine 100A, and the pullback process will be restarted.

From the above discussion, it should be appreciated that the transition phase occurs whenever the HDD machine 100B is actually entering the freewheel mode, and not necessarily in response to the operator selecting the freewheel mode. For example, the transition occurs when the control system 400 automatically changes from freewheel suspend back into freewheel mode. Furthermore, when the operator selects the freewheel mode while the vise 520 is clamped, the HDD machine 100B will automatically enter the freewheel suspend mode instead of the freewheel mode—without requiring the above-described transition phase and notification. Instead, the transition phase and subsequent attainment of the freewheel mode are triggered when the vise 520 is determined to be released and the machine remains set to the freewheel mode.

The control system 400 includes a display device 300 for communicating the status of the machine to an operator, an operator input device 310 such as the button 312 for allowing an operator to select modes of operation, and control algorithms for operating the rotary drive unit 116 to selectively freewheel in coordination with other control systems of the HDD machine, to automate and coordinate various operations. The control system 400 coordinates operations in order to:

1) safeguard components of the HDD machine 100B, such as to safeguard the motors 130 of the rotary drive unit 116;
2) to maximize the efficiency of operation;
3) to inform the operator of the status of the machine, to reduce the probability for an operator to operate the machine inappropriately;

One example of inappropriate operation is when an operator would allow the pilot side HDD machine 100A to rotate the drill string 104, and thus the tail string 112, before the exit side HDD machine 100B is completely in the freewheel mode. If this inappropriate operation occurs, and the motor 130 at the exit side HDD machine 100B is forced to rotate, the pistons will contact the cam-ring in a way that can result in damage to the motor 130. This inappropriate operation can result from the operator not waiting long enough to allow the hydraulic control system to close the ball valves 168, 170 and to allow the case pressure to force the pistons inward. The processes associated with moving the linkage 216 to close the ball valves 168, 170 and with the hydraulic system to affect the charge pressure and the case pressure, takes some time, it can take up to four to five seconds, or more, to switch from operating mode to freewheel mode. The systems of the HDD machine 100B that are changed during a switch in operating modes are not visible to an operator. Thus, the control system 400 acts to appropriately inform an operator of the mode of the HDD machine 100B.

In addition to generating information for the operator, to protect the components of the machine, the control system 400 may have another operating mode that is intended to remind the operator and any other workers or bystanders near the second HDD machine 100B, specifically that the HDD machine is in the freewheel mode, while an operator is not at the machine controls of a control station thereof. This may occur when the operator of the second HDD machine 100B leaves the operator station for any reason, while it is operating in the freewheel mode. In the freewheel mode, the second HDD machine 100B is configured to allow the first HDD machine 100A to rotate and pull the drill string 104. When the HDD machine 100B is operating in a normal mode, and when it is not connected to another machine, an operator presence system may result in interruption of machine functions when an operator is detected absent from the operator station. When the machine functions are interrupted, the components of the HDD machine 100B are prevented from moving. However, when in the freewheel mode, the second HDD machine 100B is intentionally in a mode where it is allowing some of its components, such as the output 136 of the rotary drive unit 116, to be passively moved (e.g., by torque from the first HDD machine 100A). This freewheeling mode and situation are unique and can call for a unique adaptation of conventional operator presence lockout controls.

Figure 12A:
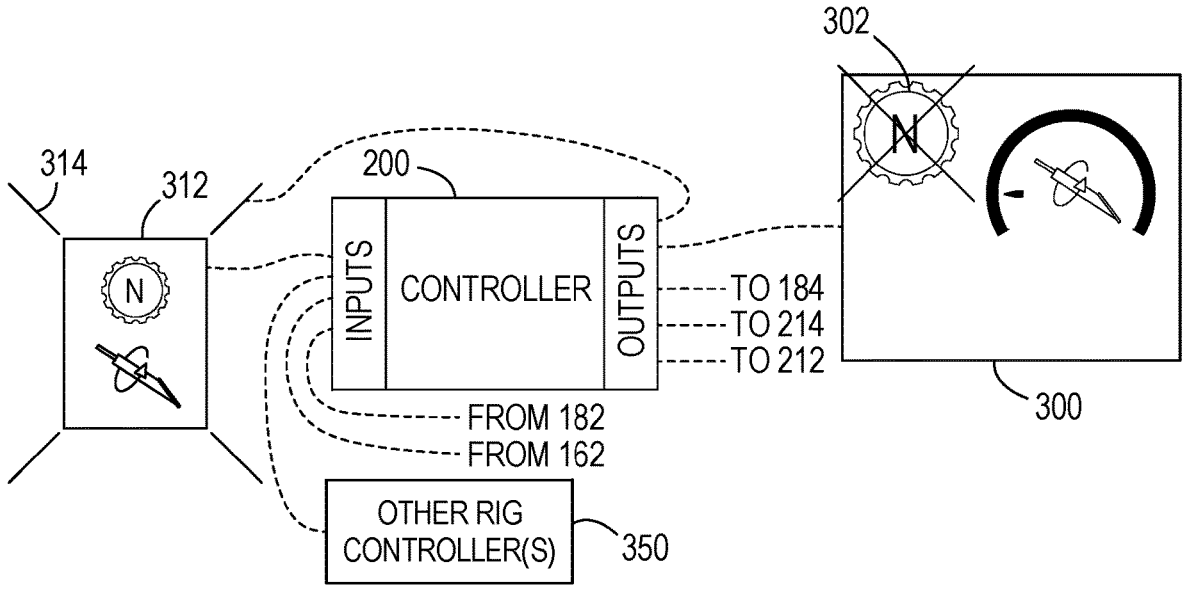
FIG. 12A is an illustration of the control system in a freewheel mode.
Figure 12B:
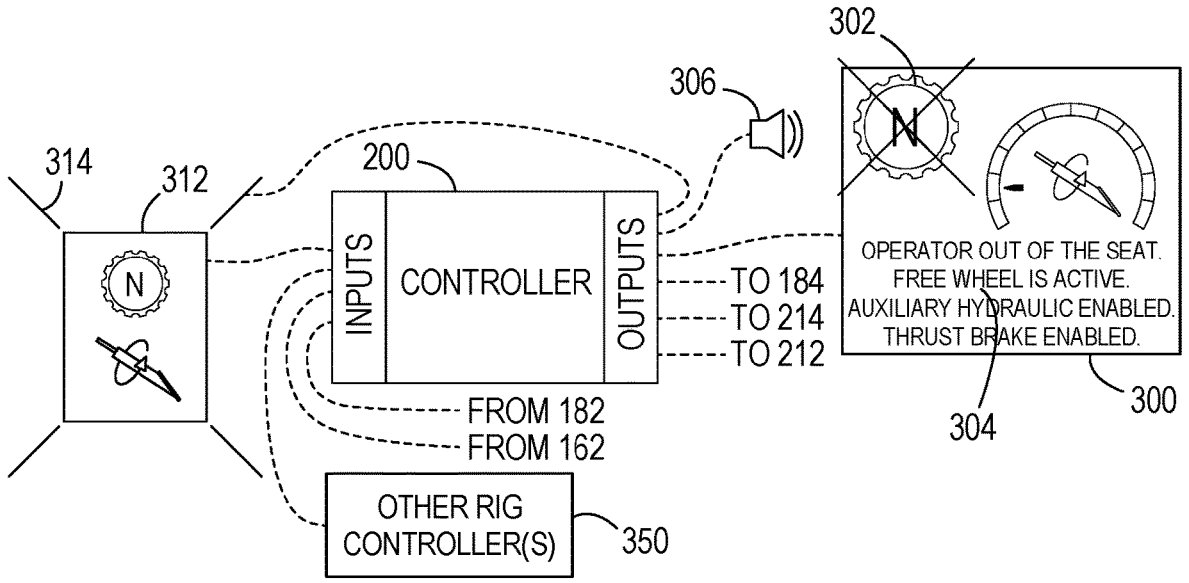
FIG. 12B is an illustration of the control system in a LOOP mode.

A unique operator warning system has been developed to remind the operator that the HDD machine 100B is in the freewheel mode when the operator is no longer at the controls, and to inform any bystanders of this condition. This mode is herein described as the Lack of Operator Presence (LOOP) mode. The control system 400 includes the controller 200 with control logic that includes algorithms that monitor the mode of the HDD machine 100B and that monitors an operator presence sensor 404. In some constructions, the operator presence sensor 404 can be provided as a seat sensor configured to detect (e.g., by weight or deflection in the seat) whether the operator is seated at the control station having all the machine controls (e.g., in the cab of FIG. 2). Other available sensors may be used in lieu of or in combination with a seat sensor to detect operator presence at the control station. If the machine 100B is in the freewheel mode and the operator presence sensor indicates that the operator is not present, then it will automatically enter the LOOP mode, rather than locking out the machine, as may normally occur if the operator's absence is detected. In other words, the operator presence lockout function of the control system is selectively retarded or ignored. In the LOOP mode, the controller 200 will use the display 300 to show a message similar to the message 304 shown in FIG. 12B, with the advisory message: "Operator out of the seat. Freewheel is active. Auxiliary hydraulic enabled. Thrust brake enabled." In this mode, the controller 200 will also activate an audible alarm (e.g., horn, 306) which in one construction is energized or activated for 3 seconds, then turned off for 1 second, and that on-off sequence continues while in the LOOP mode. FIG. 12A illustrates the freewheel mode, in contrast to the LOOP mode of FIG. 12B. There will be no transitional display, but rather, as soon as the system recognizes that an operator is not present, it will change the operator display to that shown in FIG. 12B, and it will restrict (e.g., prohibit) operation of various machine components through the communication with the other rig controllers, to restrict auxiliary hydraulic functions and restrict the carriage systems as appropriate. Auxiliary hydraulics include rod loaders (e.g., as disclosed in U.S. Pat. No. 9,598,905B2, the entirety of which is hereby incorporated by reference) and the vise 520 in some constructions, and may optionally include other components or systems.

FIG. 13 illustrates the carriage drive control system 500 that is operable to control the movement of the carriage 124, including the rotary drive 116, along the rack 120. In some constructions, the carriage drive control system 500 includes a hydraulic motor 504 that is coupled with and operated by a variable hydraulic pump 508 to form a carriage drive unit, although other types of carriage drives, including electric drives, may be provided in other constructions. The carriage drive control system 500 can be considered a standalone control system or a subordinate control system to the rotary drive control system 400. Both control systems 400, 500 can utilize a common controller (e.g., the controller 200 as shown in FIG. 13), although separate controllers may be used instead. The output of the hydraulic motor 504 can include a pinion (not shown) that is engaged with the teeth of the rack 120 for moving the entire carriage 124 forward or backward along the rack 120. During normal operation, the operation of the motor 504 and thus the movement of the carriage 124 along the rack 120 is controlled by movement of an operator input device (e.g., joystick 512, as referenced in the following description). For example, moving the joystick 512 forward or backward from a neutral center position can set varying speeds of movement proportional to how far the joystick 512 is moved forward or backward (e.g., by controlling the pump 508, such as its swash plate angle). This can be true of either or both HDD machines 100A, 100B. However, the carriage drive control system 500 operates to provide an alternate mode by which the response to the control movement of the joystick 512 is transformed.

This alternate mode for the joystick 512 can correspond to the freewheel mode of the rotary drive 116 (e.g., motor(s) 130 set in freewheel mode). Thus, the alternate mode for the joystick 512 can be triggered directly or indirectly by the operator input device for mode switching (e.g., the control button 312). Either in direct response to the control button 312 being operated to switch to freewheel mode, or upon suitable time delay or feedback confirming the freewheel setting, the controller 200 is programmed to change its response to the movement of the joystick 512. In particular, the joystick 512 transitions from being an adjustable speed control for the carriage 124 to being a force adjustment control for longitudinal force on the drill string (drill string here referring to the tail string 112 as well as the additional drill string 104 extending to the first HDD machine 100A) as well as the reamer 108. In the force-controlling mode of the joystick 512, longitudinal force applied by the carriage 124 to the drill string 104, 112 can be variably adjusted proportional to how far the joystick 512 is moved. For example, an amount of backward movement of the joystick 512 as shown in FIG. 13, from its neutral center position (shown by the dashed vertical line), can correspond to an amount of tensile force to be maintained on the drill string 104, 112. In order to accomplish this, the controller 200 can receive as inputs both the position of the joystick 512 and a pressure signal(s) from a pressure sensor(s) 516 in the carriage drive unit (e.g., motor 504, pump 508, and connection lines therebetween). The pressure sensor(s) 516 can include one or more pressure transducers to detect hydraulic fluid pressure as illustrated, although the pressure sensor(s) 516 can alternately take the form of another type of transducer, such as a load cell or strain gauge that is configured to measure a property proportional to drill string longitudinal force. The controller 200 can have a PID control algorithm that correlates the joystick position to a target pressure value from a stored table and uses the measured pressure from the pressure sensor(s) 516 for feedback to produce a control signal to the carriage drive unit (e.g., swash plate of the variable pump 508). Thus, the controller 200 does not seek to move the carriage 124 at any particular speed or to any particular position, but rather controls how hard the carriage 124 pulls on the drill string 104, 112—which is being actively driven by the carriage and rotary drive of the first HDD machine 100A, independent of the second HDD machine 100B. The function of the joystick 512 in this mode is indifferent to the direction of movement of the carriage drive unit. For example, whether the first HDD machine 100A operates to push or pull the drill string 104, 112, the carriage drive control system 500 operates to maintain the drill string tension in accordance with the joystick position—and in doing so, may be required to move the carriage 124 both forward and backward at times. During a given pullback operation, the first HDD machine 100A can be intentionally operated, at times, in a back-and-forth manner—a process sometimes called "swabbing" the borehole.

Maintaining controlled tension on the drill string 104, 112 can help to maintain the predictable positioning of the drill string and reamer 108 in the borehole. Controlled tension also may help maintain the tail string 112 out of contact with the open vises 520 at the forward end of the second HDD machine 100B as the drill string 104, 112 is moved under the influence of the first HDD machine 100A. In fact, the operator may visually observe the position of the tail string 112 with respect to the open vises 520 when deciding how much drill string tension to apply through movement of the joystick 512. In some constructions, in order to guarantee some amount of drill string tension applied by the carriage 124 of the second HDD machine 100B, or at least prevent the application of any longitudinal compression, movement of the joystick 512 from the center position forward can be ignored by the controller 200. In other words, forward joystick positioning of any amount can simply correspond to zero or the minimum tension setting. In some constructions, the carriage drive control system 500 can apply a brake, internal to the motor 504 or separate therefrom, when the joystick 512 is not activated to control drill string longitudinal force (e.g., when the joystick 512 occupies the center position, and optionally also when moved forward). The operator display 300 can be coupled to the carriage drive control system 500 to display to the operator a measure of the longitudinal drill string force. For example, the force value itself may be displayed, hydraulic pressure in the carriage drive unit, and/or a percentage corresponding to the range of allowable values from the minimum (e.g., zero) value to the maximum allowable value.

Figure 14:
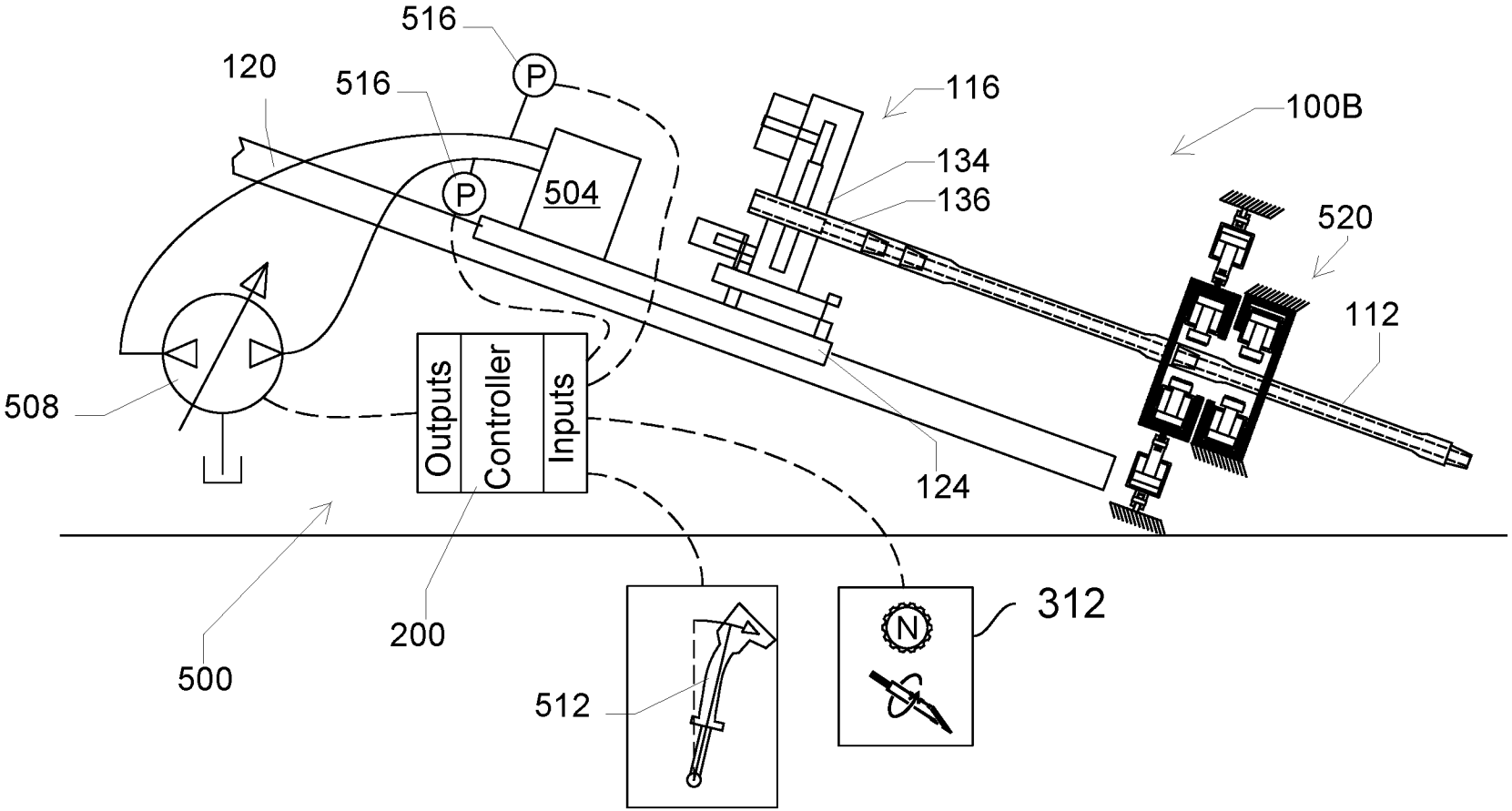
FIG. 14 is an illustration of the carriage drive control system with the joystick in a pushed forward position for controlling compression on the drill string.

In a separate embodiment, a second range of movement of the joystick 512 (e.g., forward movement from the center position as shown in FIG. 14) can be configured to control an amount of compression force applied by the carriage 124 to the drill string 104, 112—adjusted proportional to how far the joystick 512 is moved. The drill string compression control otherwise operates the same as that described directly above for the tension control for the first range of movement of the joystick 512 (backward). In such an embodiment, the operator of the second HDD machine 100B can choose to apply either tension or compression at a given time during operation.

Figure 15:
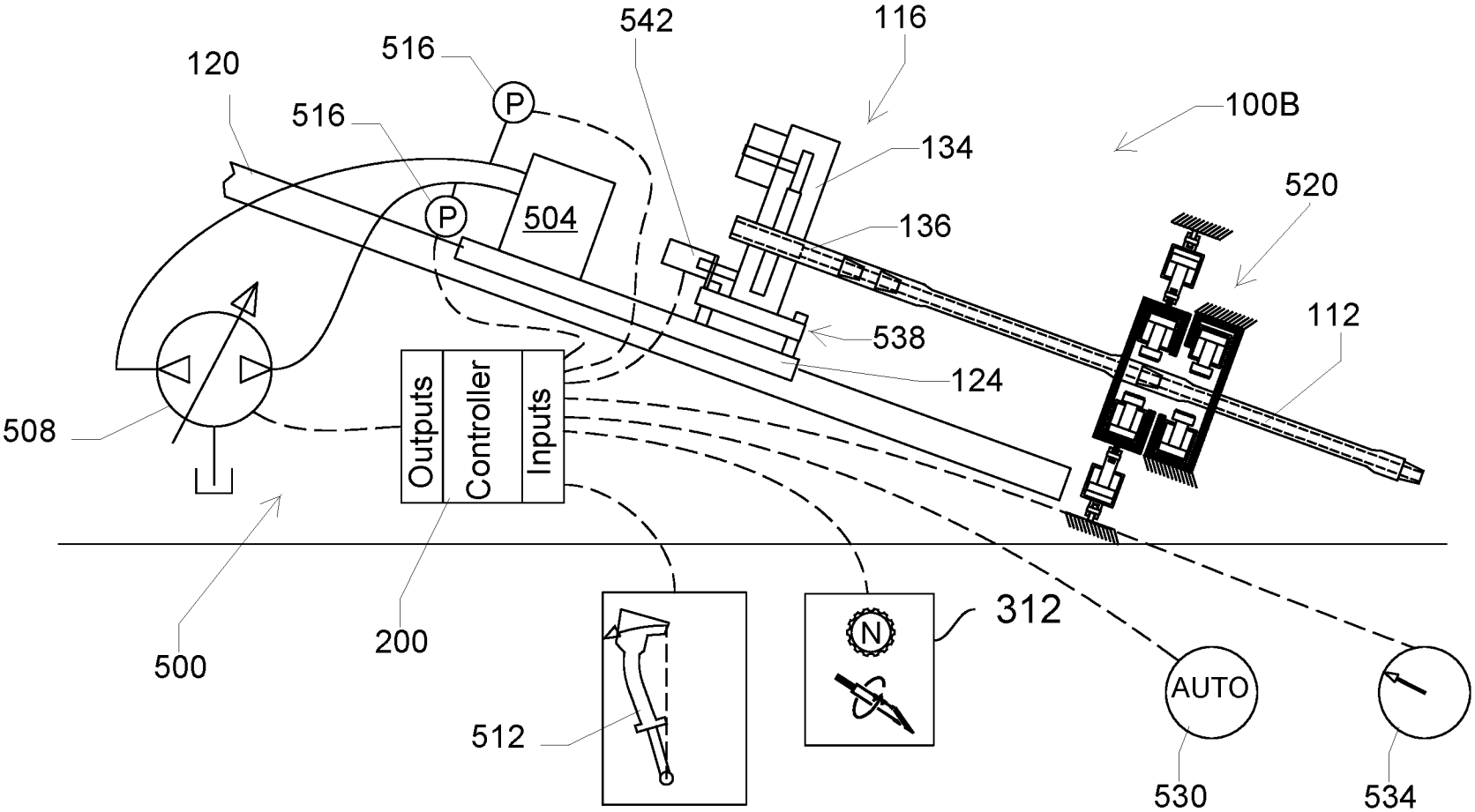
FIG. 15 is an illustration of the carriage drive control system with a further automatic control mode that maintains system function while the joystick is released.

FIG. 15 illustrates an optional extended function of the carriage drive control system 500 described above with respect to FIG. 13 for controlling drill string longitudinal force during freewheel mode. Upon the operator manipulating the joystick 512 to set the desired longitudinal force, the operator can activate an automatic control mode that frees the operator from the need to maintain the joystick position. The automatic control mode, or simply "AUTO mode" can be activated through an operator input, or "AUTO mode selector," such as a push button 530 as shown in FIG. 15. The carriage drive control system 500, utilizing the controller 200 in a manner similar to that described above with respect to the direct control by the joystick 512, operates to maintain the operator-selected amount of drill string longitudinal force while the joystick 512 can be released and allowed to return to the center position. The operator-selected amount of drill string longitudinal force can be rendered adjustable during operation in the AUTO mode, for example by a secondary adjustment control 534 (e.g., knob, lever, +/−buttons, etc.). The AUTO mode can be exited upon a subsequent action by the operator, such as movement of the joystick 512 or operating the AUTO mode selector 530 while in the AUTO mode. The secondary adjustment control 534 can offer adjustment corresponding to the machine's full range of allowable drill string longitudinal force, or merely a smaller subset thereof. The AUTO mode can allow the drill string longitudinal force to be set at any desired value within the allowable range, including zero longitudinal force.

In the case of zero longitudinal force setting for the AUTO mode, the carriage drive control system 500 can be configured to monitor the position of the gearbox 134 with respect to a gearbox slide 538. The gearbox slide 538 is a portion of the carriage 124 that provides a limited amount of free movement for the gearbox 134, which movement is required to accommodate the longitudinal component of movement during a drill rod attachment or detachment process (threading or unthreading). Thus, the gearbox 134 generally shifts forward in the slide 538 when the drill string is tensioned (FIG. 13) and shifts rearward in the slide 538 when the drill string is in compression (FIG. 14). As illustrated in FIG. 15, a position sensor 542 can operate to detect the position of the gearbox 134 with respect to the slide 538, and a representative signal is provided to the controller 200. The signal from the position sensor 542 can be used, either alone or in conjunction with the pressure sensor(s) 516 to control the carriage drive unit to achieve the zero longitudinal force setting when instructed by the operator. For example, the controller 200 can control the carriage drive unit in a way that maintains the gearbox 134 generally centered with respect to the slide 538. The position sensor 542 can be used to enable the controller 200 to quickly observe and respond to drill string directional changes imparted from the first HDD machine 100A since the position of the gearbox 134 with respect to the slide 538 changes directly and instantly with changes to drill string longitudinal force.

Aspects of the disclosure, including the structures and methods of operation described above and illustrated in the drawings are not limited to the explicit nature of this disclosure. For example, the freewheel mode may be included in an entry side HDD machine (e.g., the first HDD machine 100A), and application may also be found for aspects or portions of the disclosure outside of the field of horizontal directional drilling.

Various features of the disclosure are set forth in the following claims.

What is claimed is:

1. A horizontal directional drilling machine comprising:

a rotational drive unit having an output member configured to connect with and selectively drive rotation of a drill string when the rotational drive unit is in a first mode, the output member of the rotational drive unit configured to be rotated by the drill string when the rotational drive unit is in a second mode;

a vise operable to clamp two consecutive drill rods of the drill string for threading or unthreading by the rotational drive unit;

an operator input device that allows an operator to select between the first and second modes of the rotational drive unit; and a control system including a controller connected for signal communication with the rotational drive unit and the operator input device, wherein the control system is configured to, in response to receiving an input to the operator input device to change from the first mode to the second mode:

direct the rotational drive unit into the second mode when the vise is unclamped; and direct the rotational drive unit into a suspend mode when the vise is clamped, the control system automatically directing the rotational drive unit from the suspend mode into the second mode upon unclamping of the vise.

2. The horizontal directional drilling machine of claim 1, further comprising a display configured to display information regarding the status of the rotational drive unit to the operator, wherein the display is configured to separately indicate each of the first mode, the second mode, and the suspend mode.

3. The horizontal directional drilling machine of claim 2, wherein the horizontal directional drilling machine has a transition phase that occurs during a time period required for the rotational drive unit to transition into the second mode, and the display is configured to provide an indication of the transition phase, separate from the first mode, the second mode, and the suspend mode.

* * * * *